US011415149B2

(12) United States Patent
Karstadt et al.

(10) Patent No.: US 11,415,149 B2
(45) Date of Patent: Aug. 16, 2022

(54) COMPRESSOR INLET ARRANGEMENT

(71) Applicant: BorgWarner Inc., Auburn Hills, MI (US)

(72) Inventors: Sascha Karstadt, Undenheim (DE); Waldemar Henke, Griesheim (DE); Sebastian Dauscher, Immesheim (DE)

(73) Assignee: BorgWarner Inc., Auburn Hills, MI (US)

( * ) Notice: Subject to any disclaimer, the term of this patent is extended or adjusted under 35 U.S.C. 154(b) by 0 days.

(21) Appl. No.: 17/051,878

(22) PCT Filed: May 1, 2019

(86) PCT No.: PCT/US2019/030125
§ 371 (c)(1),
(2) Date: Oct. 30, 2020

(87) PCT Pub. No.: WO2019/213204
PCT Pub. Date: Nov. 7, 2019

(65) Prior Publication Data

US 2021/0190091 A1 Jun. 24, 2021

(30) Foreign Application Priority Data

May 2, 2018 (EP) ..... 18170416

(51) Int. Cl.
*F04D 29/46* (2006.01)
*F04D 29/08* (2006.01)

(52) U.S. Cl.
CPC ..... *F04D 29/464* (2013.01); *F04D 29/083* (2013.01); *F05D 2250/51* (2013.01); *F05D 2260/56* (2013.01)

(58) Field of Classification Search
CPC ..... F04D 29/464; F04D 29/083; F04D 27/02; F04D 27/0253; F05D 2250/51; F05D 2260/56
See application file for complete search history.

(56) References Cited

U.S. PATENT DOCUMENTS 4,893,225 A * 1/1990 Solomon ..... F21V 9/40 362/293
5,207,559 A * 5/1993 Clevenger ..... F04D 29/462 415/166

(Continued)

FOREIGN PATENT DOCUMENTS

CN 101504011 A 8/2009
CN 104870828 A 8/2015

(Continued)

OTHER PUBLICATIONS

English language abstract and machine-assisted English translation for DE 10 2010 026 176 extracted from espacenet.com database on Nov. 11, 2020, 8 pages.

(Continued)

*Primary Examiner* — David E Sosnowski
*Assistant Examiner* — Wayne A Lambert
(74) *Attorney, Agent, or Firm* — Howard & Howard Attorneys PLLC

(57) ABSTRACT

This disclosure relates to an arrangement 10 for variably adjusting the cross-section of a compressor inlet. Furthermore, the disclosure relates to a charging device having such an arrangement 10. The arrangement 10 comprises a compressor housing 100 with a main body 140 and an inlet cover 120. The inlet cover 120 defines a compressor inlet 110. The arrangement 10 further comprises an adjustment mechanism 200 which is arranged in the compressor housing 100. The adjustment mechanism 200 comprises an actuation ring 210 and a plurality of orifice elements 220. Each orifice element (Continued)

220 is coupled to the actuation ring 210 via a respective coupling element 230 and is rotatably supported in the compressor housing 100 via a respective shaft 240. Furthermore, the arrangement 10 comprises at least one wear reducing feature providing a wear reduced operation of the adjustment mechanism 200.

13 Claims, 13 Drawing Sheets

(56) References Cited

U.S. PATENT DOCUMENTS

| | | | | |
|---|---|---|---|---|
| 5,458,472 | A * | 10/1995 | Kobayashi | F04C 29/0057 418/55.5 |
| 6,099,168 | A | 8/2000 | Sishtla | |
| 6,666,237 | B2 * | 12/2003 | De Antoni Migliorati | B65B 39/005 141/286 |
| 6,682,299 | B2 * | 1/2004 | Bowen | F01D 11/001 415/160 |
| 7,137,778 | B2 * | 11/2006 | Marcis | F01D 17/165 415/163 |
| 8,245,530 | B2 | 8/2012 | Sugitani | |
| 8,480,357 | B2 * | 7/2013 | Nikolic | F01D 17/165 415/160 |
| 9,708,925 | B2 * | 7/2017 | Mohtar | F04D 27/002 |
| 10,393,009 | B2 * | 8/2019 | Mohtar | F04D 29/464 |
| 10,465,706 | B2 * | 11/2019 | Lombard | F02B 37/00 |
| 10,550,761 | B2 * | 2/2020 | Lombard | F04D 29/4206 |
| 2004/0096316 | A1 * | 5/2004 | Simon | F02B 37/225 415/151 |
| 2006/0261303 | A1 * | 11/2006 | Thomas | F16K 3/03 251/212 |
| 2010/0307151 | A1 * | 12/2010 | French | F04D 29/441 60/605.1 |
| 2014/0026585 | A1 * | 1/2014 | Baldwin | F01D 9/026 60/772 |
| 2014/0064934 | A1 | 3/2014 | Husted | |
| 2014/0308110 | A1 | 10/2014 | Houst et al. | |
| 2015/0041695 | A1 * | 2/2015 | Daniels | F16K 31/53 251/212 |
| 2015/0055898 | A1 * | 2/2015 | Kayser | F16C 17/047 384/123 |
| 2016/0131145 | A1 | 5/2016 | Mohtar et al. | |
| 2016/0146099 | A1 | 5/2016 | Mohtar et al. | |
| 2017/0211707 | A1 * | 7/2017 | Wakayama | F16K 3/03 |
| 2017/0298953 | A1 | 10/2017 | Lombard et al. | |
| 2017/0320470 | A1 * | 11/2017 | Belanger | F04D 29/703 |
| 2020/0291852 | A1 | 9/2020 | Karstadt et al. | |
| 2020/0309141 | A1 * | 10/2020 | Vuletic | F04D 27/0253 |

FOREIGN PATENT DOCUMENTS

| | | | | |
|---|---|---|---|---|
| DE | 10 2010 026 176 | | 1/2012 | |
| DE | 102010026176 | A1 | 1/2012 | |
| DE | 10 2013 003 418 | | 8/2014 | |
| DE | 102013003418 | A1 | 8/2014 | |
| DE | 102018218208 | A1 * | 8/2019 | F02B 39/00 |
| EP | 0913583 | A1 * | 5/1999 | F04D 29/0516 |
| WO | 2018106620 | A1 | 6/2018 | |

OTHER PUBLICATIONS

Machine-assisted English language abstract and machine-assisted English translation for DE 10 2013 003 418 extracted from espacenet.com database on Nov. 11, 2020, 11 pages.

International Search Report for Application No. PCT/US2019/030125 dated Sep. 26, 2019, 3 pages.

English language abstract for CN 101504011 A extracted from espacenet.com database on Jun. 29, 2022, 1 page.

English language abstract for CN 104870828 A extracted from espacenet.com database on Jun. 29, 2022, 1 page.

* cited by examiner

COMPRESSOR INLET ARRANGEMENT

CROSS-REFERENCE TO RELATED APPLICATIONS

The present application is the National Stage of International Patent Application No. PCT/US2019/030125 filed on May 1, 2019, which claims priority to and all the benefits of European Patent Application No. 18170416.4 filed on May 2, 2018, which are hereby expressly incorporated herein by reference in their entirety.

TECHNICAL FIELD

This disclosure relates to an arrangement for variably adjusting the cross-section of a compressor inlet. Furthermore, the invention relates to a charging device having such an arrangement.

BACKGROUND

The individual mobility sector is experiencing a disruptive change. Especially, the increasing number of electric vehicles entering the market demands higher efficiencies from traditional internal combustion engine ICE vehicles. Therefore, more and more vehicles are equipped with efficiency increasing measures, such as charging devices or lightweight design. Well known are, for instance, charging devices wherein a compressor, which may be driven by an e-motor or an exhaust gas powered turbine, provides compressed air to the ICE. This leads to a performance enhancement of the ICE.

Common compressors thereby comprise a compressor housing and a compressor wheel which is arranged in the housing. In operation, air is sucked through a compressor inlet of the housing and is accelerated by the compressor wheel and then exits the compressor via a volute of the compressor housing. Each compressor has its characterizing compressor map defining its operating range. This operating range is mainly bound by the surge line and the choke line in the compressor map.

To further improve the efficiency of the ICE, it is well known to enhance the compressor map, e.g. by preventing surging, i.e. by taking measures to move the surge line to the left. This can be done, for example, by compressor inlet adjustment mechanisms. Common adjustment mechanisms are configured, for instance, to increase the speed of the air flow, to modify the flow angle or to establish a flow path recirculation. These measures typically require space, may increase the weight and may increase the need for maintenance due to wear.

Accordingly, the objective of the present invention is to increase the efficiency of a compressor.

SUMMARY

The present invention relates to an arrangement for variably adjusting the cross-section of a compressor inlet as set out in claim 1, and a corresponding charging device including such an adjustment mechanism as set out in claim 15. Other embodiments are described in the dependent claims.

The arrangement for variably adjusting the cross-section of a compressor inlet comprises a compressor housing with a main body and an inlet cover which defines a compressor inlet. The arrangement further comprises an adjustment mechanism which is arranged in the compressor housing. The adjustment mechanism comprises an actuation ring and a plurality of orifice elements. Each orifice element is coupled to the actuation ring via a respective coupling element and is rotatably supported in the compressor housing via a respective shaft. Furthermore, the arrangement comprises at least one wear reducing feature providing a wear reduced operation of the adjustment mechanism. By having a wear reduced operation of the adjustment mechanism, each adjustment operation produces less wear which leads to a more precise actuation and less actuation force is needed as the movement is smoother. Furthermore, functional failures as a result of too much wear can be reduced and the lifecycle of the whole system can be enhanced.

In another aspect, the at least one wear reducing feature may comprise a ring-shaped insert member of the compressor housing. The ring-shaped insert member is arranged axially between the orifice elements and the main body. Thereby, the ring-shaped insert member is configured to axially support the adjustment mechanism axially opposite of the inlet cover. This advantageous feature effects that the adjustment mechanism, in particular the orifice elements, can slide on the ring-shaped insert member during actuation. Thus, in comparison to a system without the ring-shaped insert member, there is no friction present between the main body and the orifice elements. Thereby, damage on the main body due to wear can be prevented.

In another aspect, which is combinable with the previous aspect, the ring-shaped insert member may be attached to the main body by means of a press-fit. The press-fit may be formed between an inner circumferential surface of the main body and an outer circumferential surface of the ring-shaped insert member. Additionally or alternatively, the ring-shaped insert member may attached to the main body by means of two or more press-fit pins. Each of the press-fit pins may be arranged in a press-fitting manner in a respective attachment bore of the main body and in a respective attachment bore of the ring-shaped insert member. That means, each press-fit pin extends from one respective attachment bore of the main body into a respective attachment bore of the ring-shaped insert member. Additionally or alternatively, the ring-shaped insert member may be attached to the main body by means of two or more screws. The screws may extend through respective attachment bore of the ring-shaped insert member into a respective attachment bore of the main body.

In another aspect, which is combinable with any one of the previous two aspects, the ring-shaped insert member may comprise a plurality of bores. Each of the plurality of bores is configured to rotatably receive a respective shaft. The plurality of bores is circumferentially distributed on a first annular end face of the ring-shaped insert member whereby the first annular end face faces axially towards the adjustment mechanism.

In another aspect, which is combinable with any one of the previous two aspects, each of the shafts has an axial length which is longer than an axial length of each respective bore. A shaft being longer than a respective bore enables the possibility that, during rotation of a respective orifice element, a frictional area between the orifice element and the compressor housing can be reduced as the orifice element can slide on the compressor housing via its shaft.

In another aspect, which is combinable with any one of the three previous aspects, each of the plurality of bores is a through hole. Alternatively, each of the plurality of bores is a blind hole.

In another aspect, which is combinable with any one of the for previous aspects, each of the shafts may have a first end portion. The first end portion may be made of a wear reducing material or may comprise a wear reducing surface coating. In particular, the wear reducing material or the wear reducing surface coating comprises a polymer material or polymeric coating, respectively. This feature is especially advantageous in embodiments, wherein the shaft length is longer than the bore length, as each respective orifice element can slide via its shaft during rotation in a wear reduced manner. In other words, this feature further reduces the overall wear of the arrangement.

In another aspect, which is combinable with any one of the five previous aspects, each of the shafts may extend from a first end face of a base plate of an orifice element axially towards the ring-shaped insert member. Additionally, each of the shafts may extend from the first end face axially through the base plate and may further extend from a second end face of the base plate, which is axially opposite of the first end face, axially towards the inlet cover. Additionally, the inlet cover may comprise a plurality of bores, each of the plurality of bores being configured to rotatably receive a respective shaft. The plurality of bores is circumferentially distributed on a first annular end face of the inlet cover, whereby the first annular end face axially faces towards the adjustment mechanism. In other words, this means that each shaft extends in both axial directions from the respective orifice element. Thereby, tilting of the orifice elements can be reduced or prevented, as each orifice element is guided on both axial sides via its respective shaft.

In another aspect, which is combinable with the previous aspect, each of the shafts has a second end portion axially opposite of the first end portion. The second end portion may be made of a wear reducing material or may comprise a wear reducing surface coating. In particular, the wear reducing material or the wear reducing surface coating may comprise a polymer material or polymeric coating, respectively.

In another aspect, which is combinable with any one of the previous aspects, each orifice element may comprise a central bore extending axially through the base plate of each respective orifice element and wherein each central bore is configured to receive a respective shaft.

In another aspect, which is combinable with any one of the previous aspects, each respective shaft may be integrally formed with a respective orifice element.

In another aspect, which is combinable with any one of the previous aspects if comprising the annular ring-shaped member, the ring-shaped insert member may be made of a wear reducing material or may comprise a wear reducing surface coating. In particular, the wear reducing material or the wear reducing surface coating may comprise a polymer material or polymeric coating, respectively.

In another aspect, which is combinable with any one of the previous aspects if comprising the annular ring-shaped member, the ring-shaped insert member may be integrally formed with the compressor housing.

In another aspect, which is combinable with any one of the previous aspects, the adjustment mechanism may further comprise a plurality of plateau elements. Thereby, each of the plurality of plateau elements is arranged axially between a respective orifice element and the actuation ring. By providing a plateau element on each orifice element, the contact area, and thus, the sliding area between the orifice elements and the actuation ring can be reduced. This results in less friction in that area, leading to less wear of the adjustment mechanism.

In another aspect, which is combinable with the previous aspect, each of the plurality of plateau elements may be arranged directly adjacent to a respective coupling element.

In another aspect, which is combinable with any one of the two previous aspects, each of the plurality of plateau elements may be integrally formed with a respective coupling element and/or with a respective orifice element. Alternatively, each of the plurality of plateau elements may be integrally formed with the actuation ring.

In another aspect, which is combinable with any one of the previous aspects, the at least one wear reducing feature may comprise a plurality of distance elements. Each of the plurality of distance elements is arranged axially between a respective orifice element and the main body. By providing a distance element on each orifice element, the contact area, and thus, the sliding area between the orifice elements and the main body or, if applicable, the ring-shaped insert member, can be reduced. This results in less friction in that area, leading to less wear of the arrangement.

In another aspect, which is combinable with the previous aspect, each distance element may be integrally formed with a respective orifice element. Alternatively, each distance element may be integrally formed with a respective shaft. Alternatively, each distance element may be integrally formed with the main body or, if applicable with the ring-shaped insert member.

In another aspect, which is combinable with any one of the two previous aspects, each distance element may be configured to axially support a respective orifice element against the compressor housing. That means, each orifice element contacts the housing, i.e. the main body or, if applicable the ring-shaped insert member, via the respective distance element.

In another aspect, which is combinable with any one of the three previous aspects, each of the plurality of distance elements may be arranged adjacent a respective shaft. Thereby, when rotating an orifice element, the lever of movement is short in comparison to a distance element which is arranged further away from a respective shaft. Thus, the arc length of movement, and thereby the contact area during rotation is also reduced. This results in less friction in that area, leading to less wear of the arrangement.

In another aspect, which is combinable with any one of the four previous aspects, each distance element may comprise a ring-like shape and may circumferentially surround each respective shaft.

In another aspect, which is combinable with any one of the five previous aspects, the at least one wear reducing feature may further comprise a plurality of cams. Each of the cams is arranged axially between a respective orifice element and the inlet cover.

In another aspect, which is combinable with the previous aspect, the plurality of distance elements may be configured to interact with a correspondingly configured first annular end face of the ring-shaped insert member. Furthermore, the plurality of cams may be configured to interact with a correspondingly configured first annular end face of the inlet cover such that, in a closed position of the adjustment mechanism, in which the cross-section of the compressor inlet is minimal, the inlet cover enacts an axial pre-load on the orifice elements, to press fit the orifice elements axially between the inlet cover and the ring-shaped insert member. By axially preloading the orifice elements towards the ring-shaped insert member, an axial gap between the orifice elements and the ring-shaped insert member can be reduced or closed. This leads to a sealing effect in that area, preventing backflow of fluids from the impeller of the compressor which results in a higher efficiency of the system.

In another aspect, which is combinable with the previous aspect, each of the plurality of distance elements may have an inclined surface. The inclined surface may be configured to slidingly engage a respective portion of the first annular end face, which is correspondingly inclined. Furthermore, each of the plurality of cams may have an inclined surface. The inclined surface may be configured to slidingly engage a respective portion of the first annular end face, which is correspondingly inclined, such that a rotation of an orifice element causes an axial translation of that respective orifice element.

In another aspect, which is combinable with the previous aspect, an inclination angle β of the respective portions of the first annular end face may be larger than an inclination angle α of the respective portions of the first annular end face. This advantageous feature ensures that during rotation from an opened position to a closed position of the adjustment mechanism, the orifice elements experience an increasing axial preload.

In another aspect, which is combinable with any one of the previous aspects, the at least one wear reducing feature may comprise one or more wear reducing surface coatings, which are arranged on at least one of the inlet cover, the actuation ring and/or the orifice elements. In particular, the wear reducing surface coating may comprise a polymeric coating. This leads to a further reduction of wear in the arrangement.

The present invention further relates to a charging device. The charging device comprises an arrangement of any one of the previous aspects.

In another aspect of the charging device, which is combinable with the previous aspect, the charging device may be an exhaust gas turbocharger and may further comprise a turbine. Additionally or alternatively, the charging device may be an electrically assisted turbocharger and may further comprise an electrical assist device.

Alternatively, the charging device may be an electric charger and may further comprise an electric motor which drives the impeller mounted in the compressor housing.

DETAILED DESCRIPTION

In the context of this invention, the expressions axially, axial or axial direction is meant to be a direction parallel of or along an axis of the compressor, i.e. the rotation axis of the impeller which is mounted in the compressor housing. Thus, with reference to the figures, see, especially FIG. 1, an axial dimension is described with reference sign 22, a radial dimension extending "radially" away from the axial dimension 22 is described with reference sign 24. Furthermore, a circumferential dimension around the axial dimension 22 is described with reference sign 26.

Figure 1A:
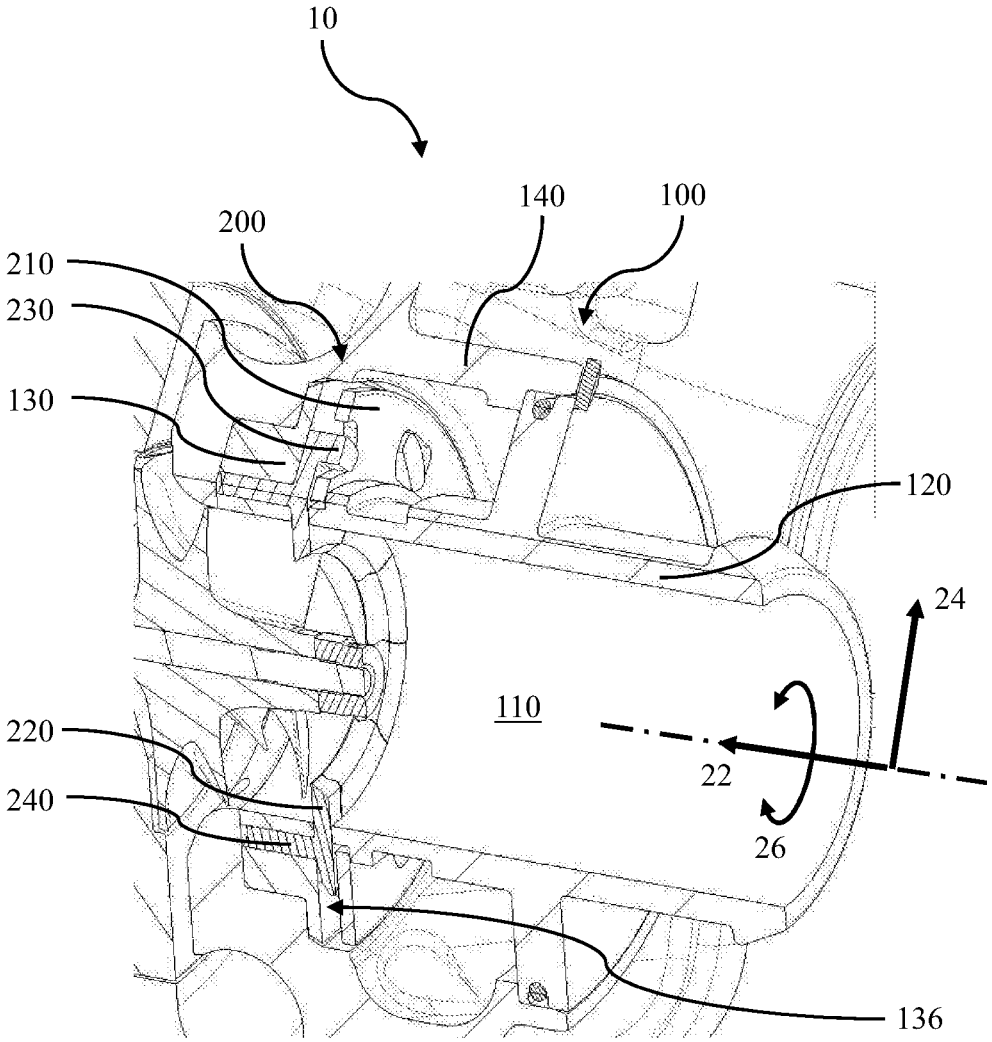
FIG. 1A shows a sectional isometric view of an arrangement according to the invention.

FIG. 1A illustrates an exemplary embodiment of an arrangement 10 for variably adjusting the cross-section of a compressor inlet 110. The arrangement 10 comprises a compressor housing 100 with a main body 140 and an inlet cover 120. The inlet cover 120 defines a compressor inlet 110. The arrangement 10 further comprises an adjustment mechanism 200 which is arranged in the compressor housing 100. Exemplary, the adjustment mechanism 200 is depicted in a closed position, thus resulting in a reduced or minimal cross-section of the compressor inlet 110, in FIG. 1A.

The adjustment mechanism 200 comprises an actuation ring 210 and a plurality of orifice elements 220. Each orifice element 220 is coupled to the actuation ring 210 via a respective coupling element 230 and is rotatably supported in the compressor housing 100 via a respective shaft 240. Furthermore, the arrangement 10 comprises at least one wear reducing feature providing a wear reduced operation of the adjustment mechanism 200. By having a wear reduced operation of the adjustment mechanism 200, each adjustment operation produces less wear which leads to a more precise actuation and less actuation force is needed as the movement is smoother. Furthermore, functional failures as a result of too much wear can be reduced and the lifecycle of the whole system can be enhanced.

As depicted in FIG. 1A, the compressor housing 100 comprises a ring-shaped insert member 130. The ring-shaped insert member 130 is arranged axially between the orifice elements 220 and the main body 140. Thereby, the ring-shaped insert member 130 is configured to axially support the adjustment mechanism 200 axially opposite of the inlet cover 120. The ring-shaped insert member 130 represents a wear reducing feature as the adjustment mechanism 200, in particular the orifice elements 220, can slide on the ring-shaped insert member 130 during actuation instead of sliding on the main body 140. Thus, in comparison to a system without the ring-shaped insert member 130 there is no friction present between the main body 140 and the orifice elements 220. Thereby, damage on the main body 140 due to wear can be prevented.

Figure 10A:
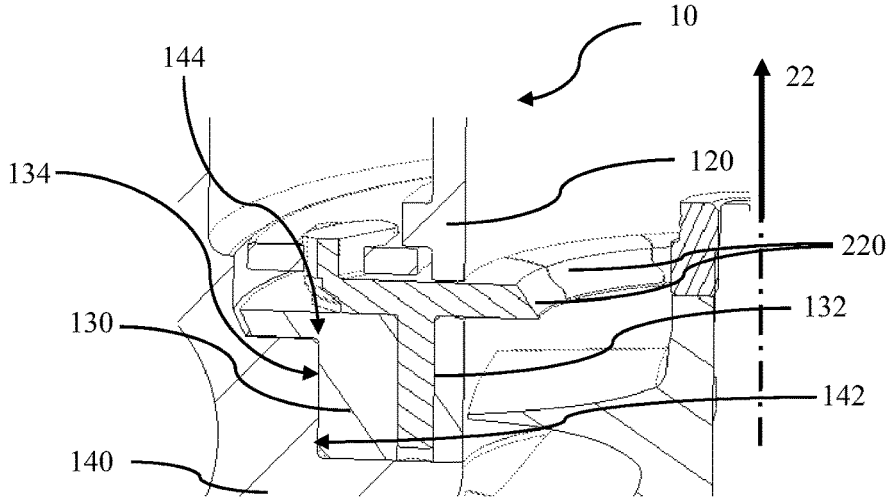
FIGS. 10A-10C show three different configurations of attaching the ring-shaped insert member to the main body.
Figure 10B:
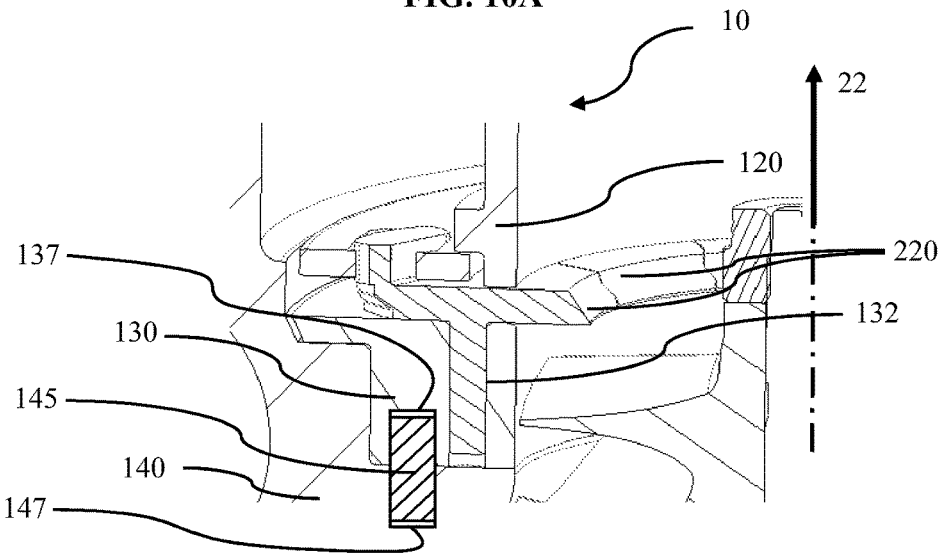
Figure 10C:
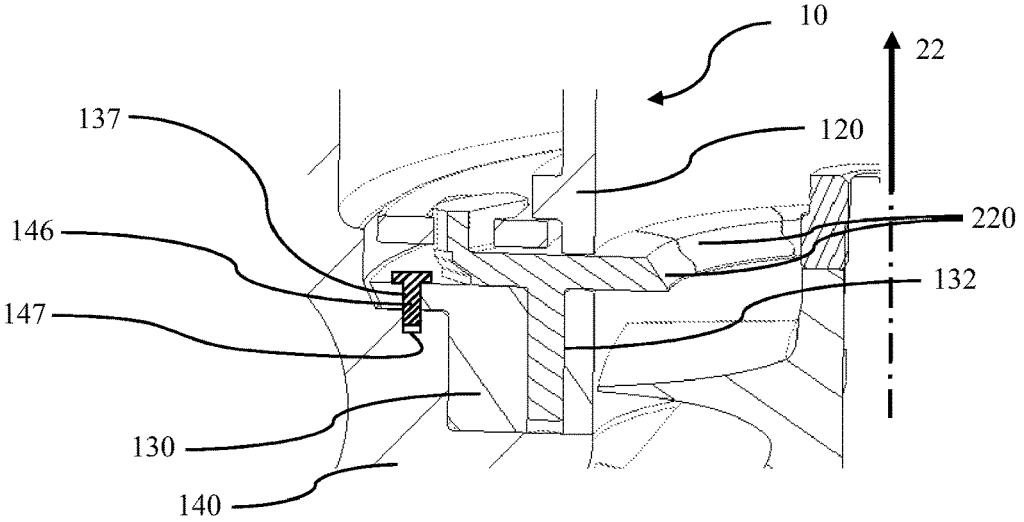

The ring-shaped insert member 130 can be attached to the main body 140 in various ways. In this regard, FIGS. 10A-10C schematically depict three exemplary ways of attachment. FIG. 10A shows an embodiment wherein the ring-shaped insert member 130 is attached to the main body 140 by means of a press-fit 144. In this example the press-fit 144 is formed between an inner circumferential surface 142 of the main body 140 and an outer circumferential surface 134 of the ring-shaped insert member 130. FIG. 10B shows an embodiment wherein the ring-shaped insert member 130 is attached to the main body 140 by means of two or more press-fit pins 145. Therefore, the main body 140 comprises two or more attachment bores 147. Each attachment bore 147 is thereby configured to receive one respective press-fit pin 145. Furthermore, the ring-shaped insert member 130 also comprises two or more attachment bores 137. Each attachment bore 137 is analogously configured to receive one respective press-fit pin 145. That means, each of the press-fit pins 145 is at the same time arranged in a press-fitting manner in a respective attachment bore 147 of the main body 140 and in in a press-fitting manner in a respective attachment bore 137 of the ring-shaped insert member 130. That means, each press-fit pin 145 extends from one respective attachment bore 147 of the main body 140 into a respective attachment bore 137 of the ring-shaped insert member 130. In the example of FIG. 10B, both attachment bores 137, 147 are be configured as blind holes. In particular, the attachment bore 137 could alternatively be configured as a through hole. Although in FIG. 10B only one press-fit pin 145 is depicted, it is to be understood that two or more press-fit pins 145 are comprised in the arrangement 10. The two or more press-fit pins 145 are circumferentially distributed. The same accounts for the respective attachment bores 137, 147 in an analogous way. In other words, the respective attachment bores 137, 147 are circumferentially distributed in the ring-shaped insert member 130 and the main body 140, respectively. FIG. 10C shows an embodiment wherein the ring-shaped insert member 130 is attached to the main body 140 by means of two or more screws 146. Therefore, the main body 140 comprises two or more attachment bores 147. Each attachment bore 147 is thereby configured to receive one respective screw 146. Furthermore, the ring-shaped insert member 130 also comprises two or more attachment bores 137. Each attachment bore 137 is analogously configured to receive one respective screw 146. Thus, each screw 146 extends through the respective attachment bore 137 of the ring-shaped insert member 130 into a respective attachment bore 147 of the main body 140. The screws 146 are inserted from a side of the actuation ring 210 in an axial direction 22 towards the ring-shaped insert member 130. Although not depicted in FIG. 10C, the actuation ring 210 could also comprise respective attachment holes through which the screws 146 can be mounted. Although in FIG. 10C only one screw 146 is depicted, it is to be understood that two or more screws 146 are comprised in the arrangement 10. The two or more screws 146 are circumferentially distributed. The same accounts for the respective attachment bores 137, 147 in an analogous way. In other words, the respective attachment bores 137, 147 are circumferentially distributed in the ring-shaped insert member 130 and the main body 140, respectively. In the example of FIG. 10C, the attachment bores 137 as a through hole. Additionally, the attachment bores 137 may be configured as sinkholes to receive the screws 146. In the latter configuration, the screws 146 are configured accordingly, i.e. as a sinkhole screw. The latter features advantageously enable a reliable axial and/or radial locking of the ring-shaped insert member 130 within the compressor housing 100, i.e. the main body 140.

Figure 1B:
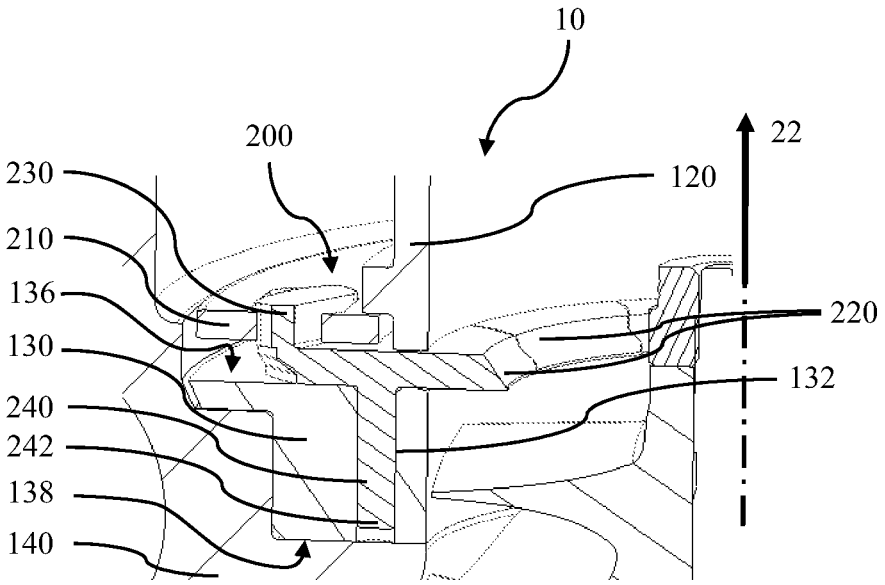
FIGS. 1B-1C show sectional isometric views of the arrangement of FIG. 1A for the description of the adjustment mechanism.
Figure 1C:
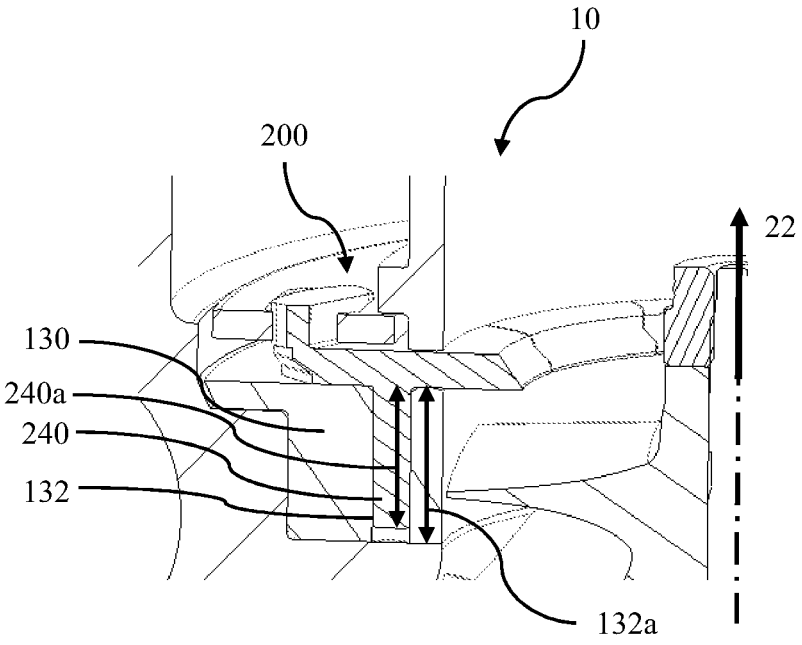

The ring-shaped insert member 130 further comprises a plurality of bores 132 which are circumferentially distributed on a first annular end face 136 of the ring-shaped insert member 130. FIGS. 1B-1C show detailed views of FIG. 1A and, amongst other features, they show the first annular end face 136 facing axially towards the adjustment mechanism 200. Each of the plurality of bores 132 is a through hole. In alternative embodiments each of the plurality of bores 132 may be a blind hole (not depicted). Exemplary depicted for one bore in FIGS. 1B-1C, each of the plurality of bores 132 is configured to rotatably receive a respective shaft 240. Thereby, an axial length 132*a* of each respective bore 132 is longer than an axial length 240*a* of a respective shaft 240 (see FIG. 1C). In this context, the expression axial length 240*a* of a respective shaft 240 refers to the length of a shaft 240 in an axial direction towards ring-shaped insert member 130. The axial length 132*a* of each respective bore 132 being longer than an axial length 240*a* of a respective shaft 240 ensures, especially when the bores 132 are through holes, that the shafts 240 do not contact the main body 140 in any condition. In alternative embodiments, the axial length 240*a* of a respective shaft 240 may be longer than the axial length 132*a* of each respective bore 132. This is especially advantageous when bores 132 are blind holes. A shaft 240 being longer than a respective bore 132 enables the possibility that, during rotation of a respective orifice element 220, a frictional area between the orifice element 220 and the compressor housing 100 can be reduced as the orifice element 220 can slide on the compressor housing 100 via its shaft 240. Furthermore, a first end portion 242 of each of the shafts 240 is made of a wear reducing material or alternatively may comprise a wear reducing surface coating. Thus, even if the axial length 240*a* would be longer than the axial length 132*a* wear on the main body would be reduced due to the first end portion 242 being made of a wear reducing material. In particular, the wear reducing material or the wear reducing surface coating comprises a polymer material or polymeric coating, respectively. This feature is especially advantageous in embodiments, wherein the shaft length 240*a* is longer than the bore length 132*a*, as each respective orifice element 220 can slide via its shaft 240 during rotation in a wear reduced manner. In other words, this feature further reduces the overall wear of the arrangement. But also in embodiments wherein the bore length 132*a* is longer the shaft length 240*a*, this feature is advantageous, as friction in a possible radial contact between shaft 240 and bore 132 may also be reduced.

Figure 2A:
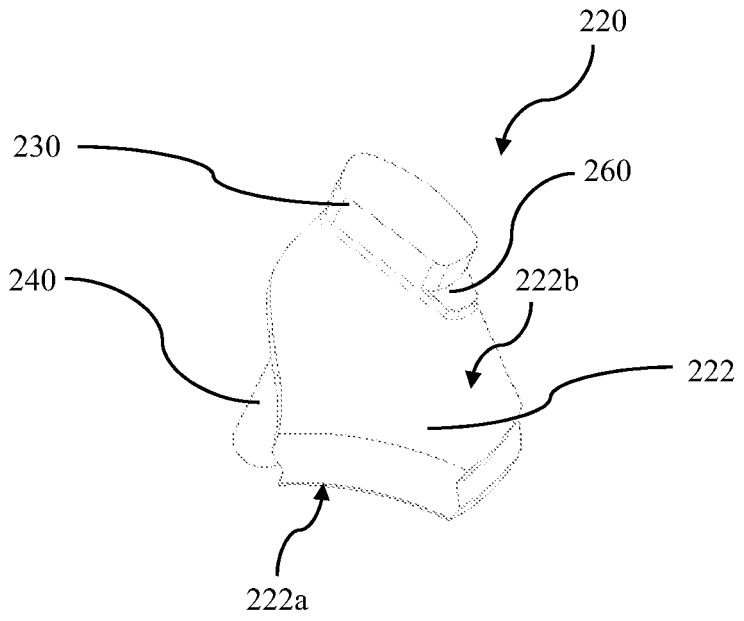
FIGS. 2A-2B show a first exemplary embodiment of an orifice element of the inventive arrangement in a detailed isometric view and mounted in the arrangement.
Figure 2B:
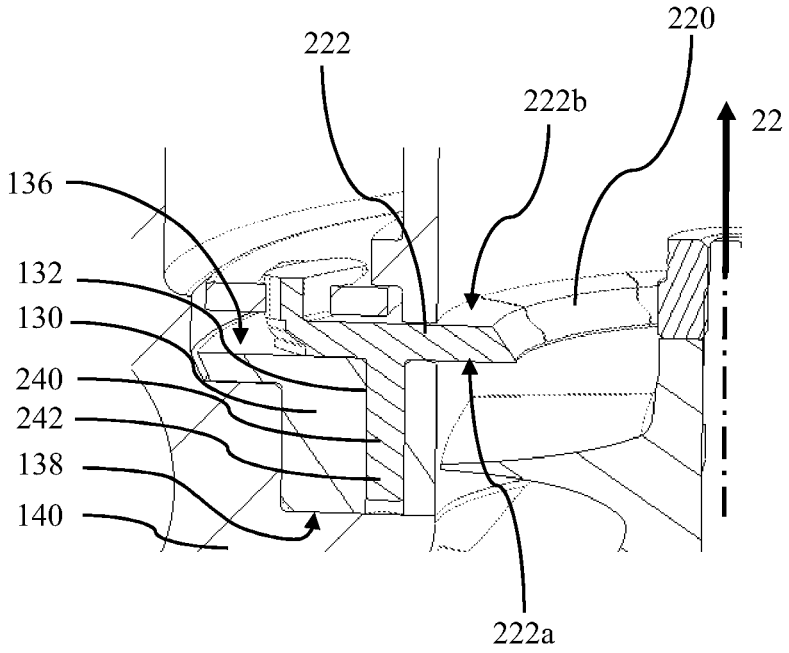

As depicted, for instance in FIGS. 2A-2B, each orifice element 220 comprises a base plate 222. The base plate 222 has a first end face 222*a* and a second end face 222*b*, the first end face 222*a* and the second end face 222*b* substantially pointing in opposite axial directions 22. In the exemplary embodiments of FIGS. 1A-2B each of the shafts 240 extends from the first end face 222*a* axially towards the ring-shaped insert member 130. Thus, in said embodiments the shafts 240 are only on one axial side of the respective orifice element 220.

Figure 3A:
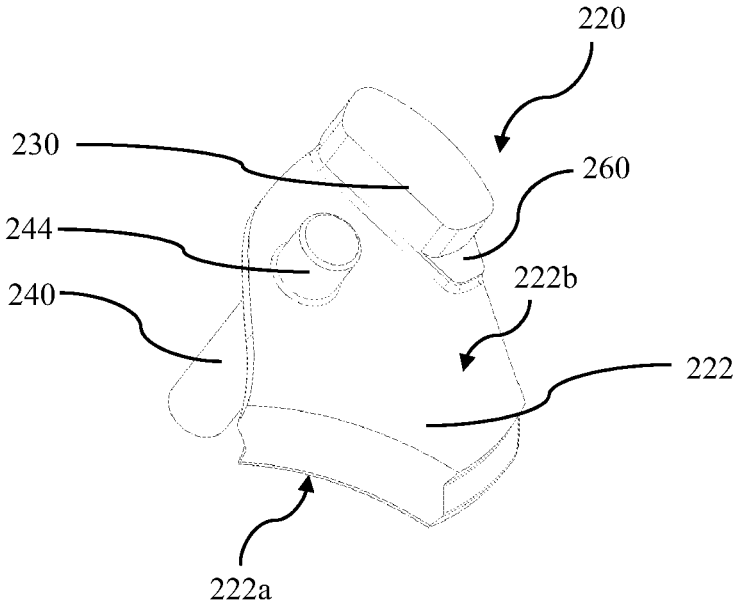
FIGS. 3A-3B show a second exemplary embodiment of an orifice element of the inventive arrangement in a detailed isometric view and mounted in the arrangement.

In the exemplary embodiments of FIGS. 3A-9C each of the shafts 240 additionally extends from the first end face 222*a* axially through the base plate 222 and further from the second end face 222*b* axially towards the inlet cover 120. In this regard, for instance FIGS. 3A-3B, show a "double sided" shaft 240 which extends to both axial sides of the orifice element 220. Accordingly, the inlet cover 120 comprises a plurality of bores 122 which are configured to rotatably receive a respective shaft 240. Therefore, the bores 122 are circumferentially distributed on a first annular end face 126 of the inlet cover 120 and adapted in size and shape to be engageable with the shafts 240. In an analogous way as described further above for the bores 132, an axial length (not depicted) of the bores 122 may be configured longer or shorter than an axial length of that part of a shaft 240 which extends from the second end face 222*b* axially towards the inlet cover 120. The first annular end face 126 axially faces towards the adjustment mechanism 200. In other words, this means that each shaft 240 extends in both axial directions 22 from the respective orifice element 220. Thereby, tilting of the orifice elements 220 can be reduced or prevented, as each orifice element 220 is guided on both axial sides via its respective shaft 240. Each of the shafts 240 has a second end portion 244 axially opposite of the first end portion 242 (see e.g. FIGS. 3A-3B). The second end portion 244 is made of a wear reducing material or may comprise a wear reducing surface coating. In particular, the wear reducing material or the wear reducing surface coating comprises a polymer material or polymeric coating, respectively. As can be seen, particularly in FIG. 3B, the second end portion 244 is mainly that portion of the shaft 240 which is resides in and rotatably engages with the respective bore 122. Thus, the rotatable movement of the shaft 240, i.e. the second end portion 244, in the respective bore 122 generates less friction.

Figure 3B:
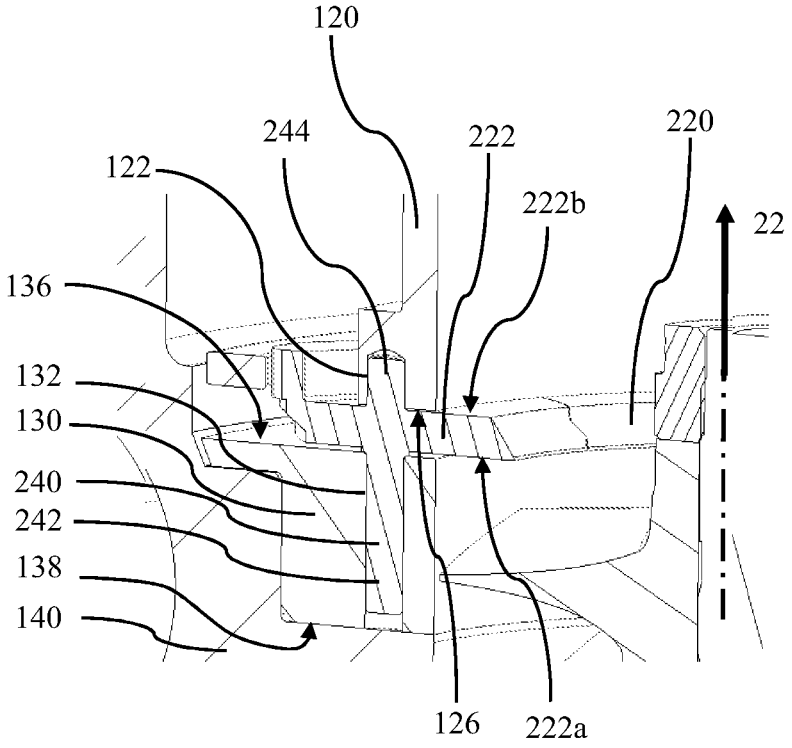
Figure 3C:
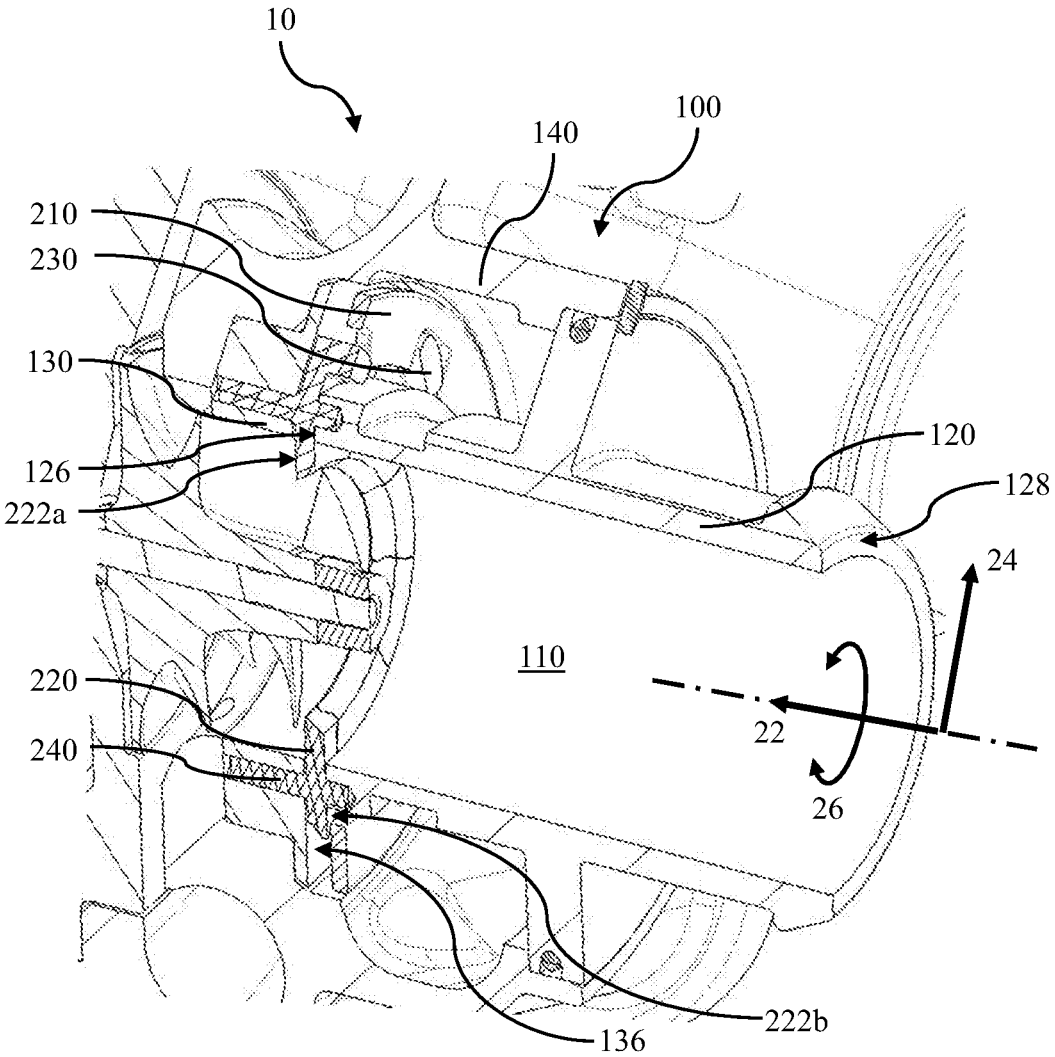
FIG. 3C shows a sectional isometric view of an arrangement according to the embodiment of FIGS. 3A-3B.
Figure 4A:
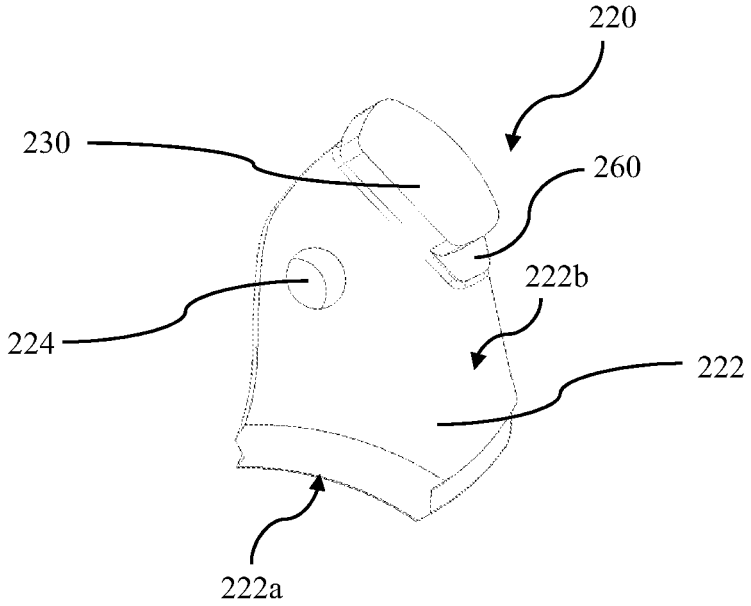
FIGS. 4A-4B show a third exemplary embodiment of an orifice element of the inventive arrangement in a detailed isometric view and mounted in the arrangement.
Figure 4B:
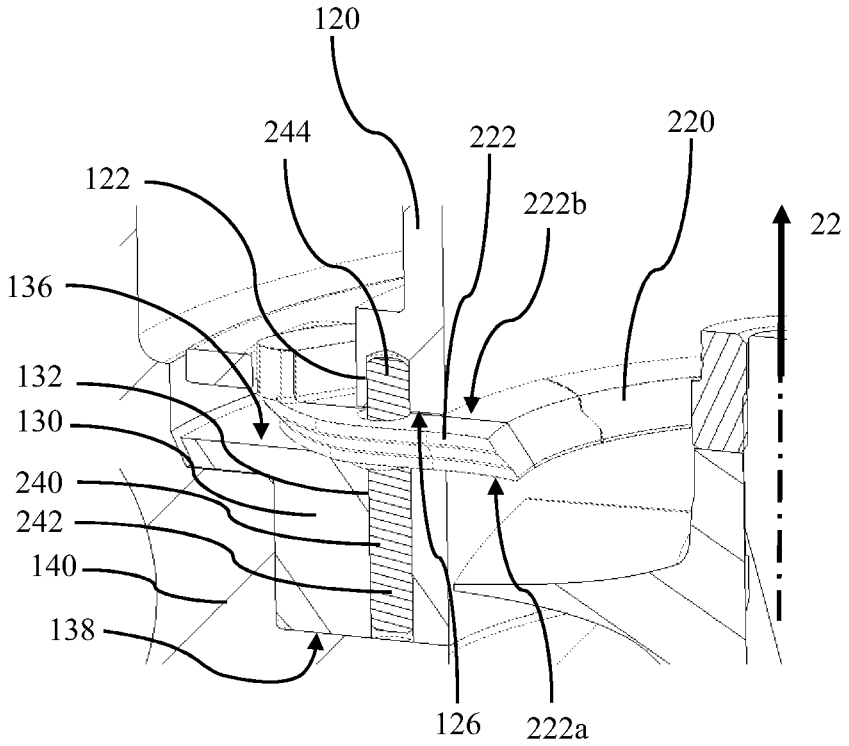
Figure 5A:
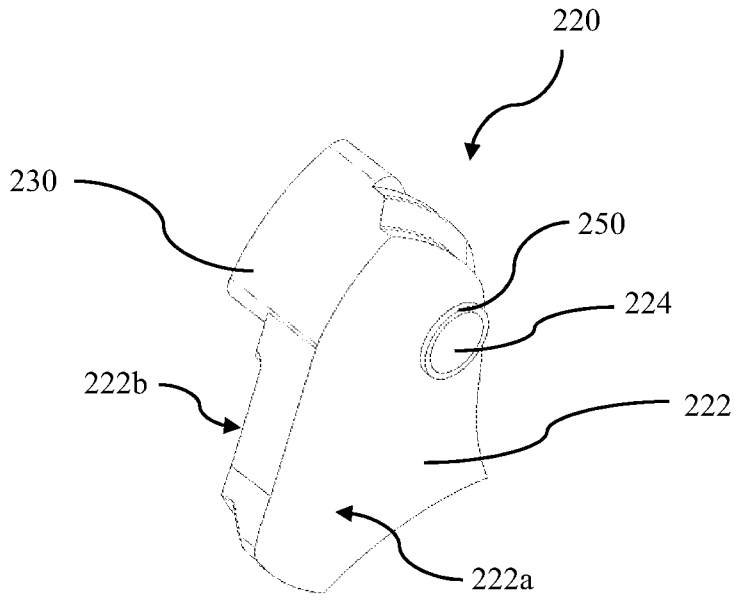
FIGS. 5A-5B show the inventive arrangement with distance elements in a first exemplary embodiment.
Figure 5B:
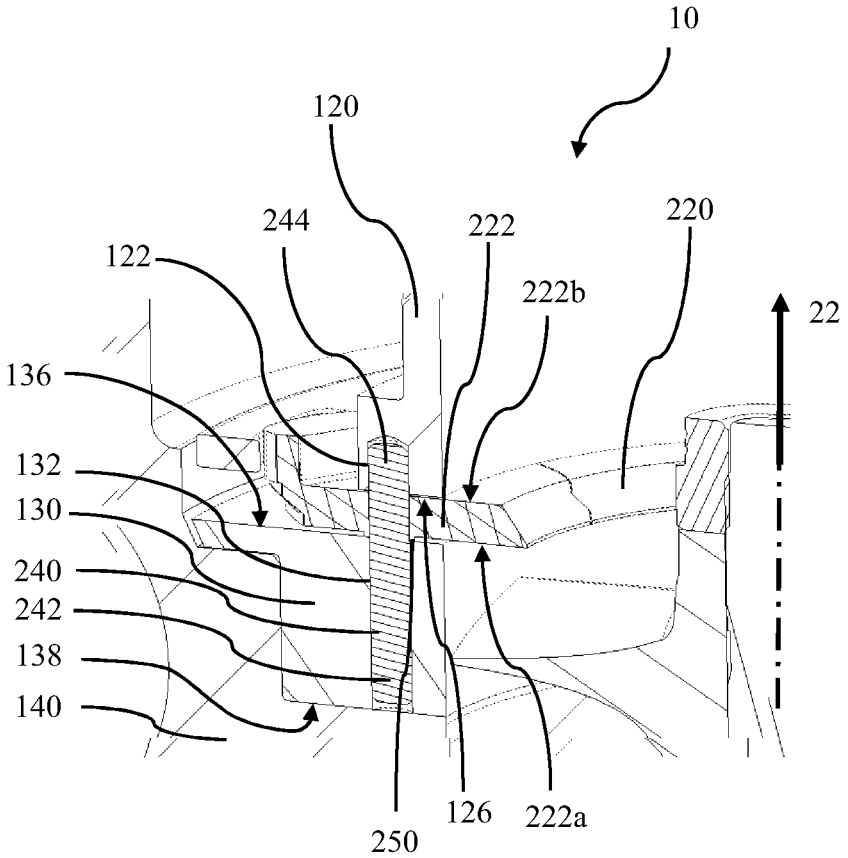
Figure 6A:
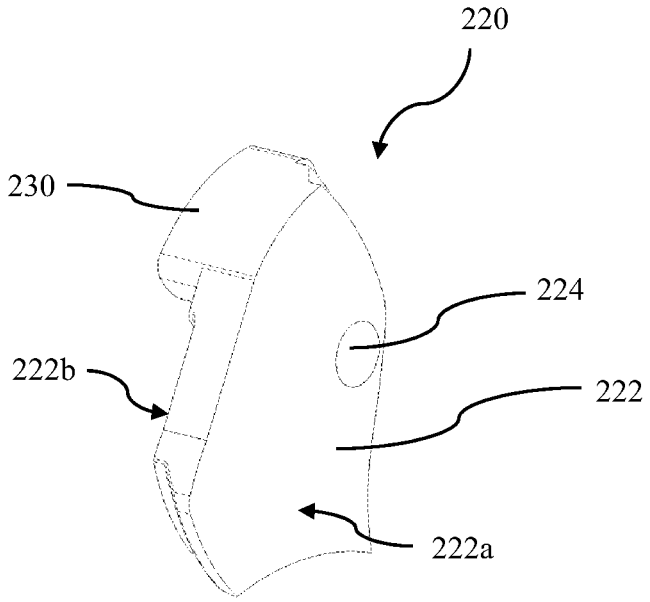
FIGS. 6A-6C show the inventive arrangement with a second exemplary embodiment of distance elements.
Figure 6B:
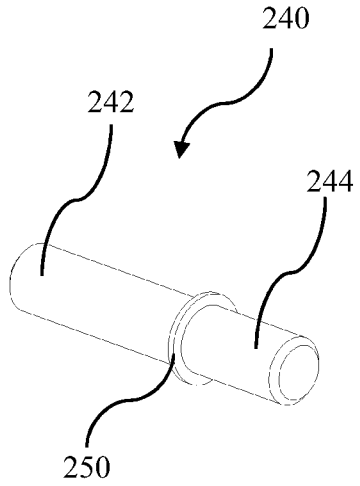
Figure 6C:
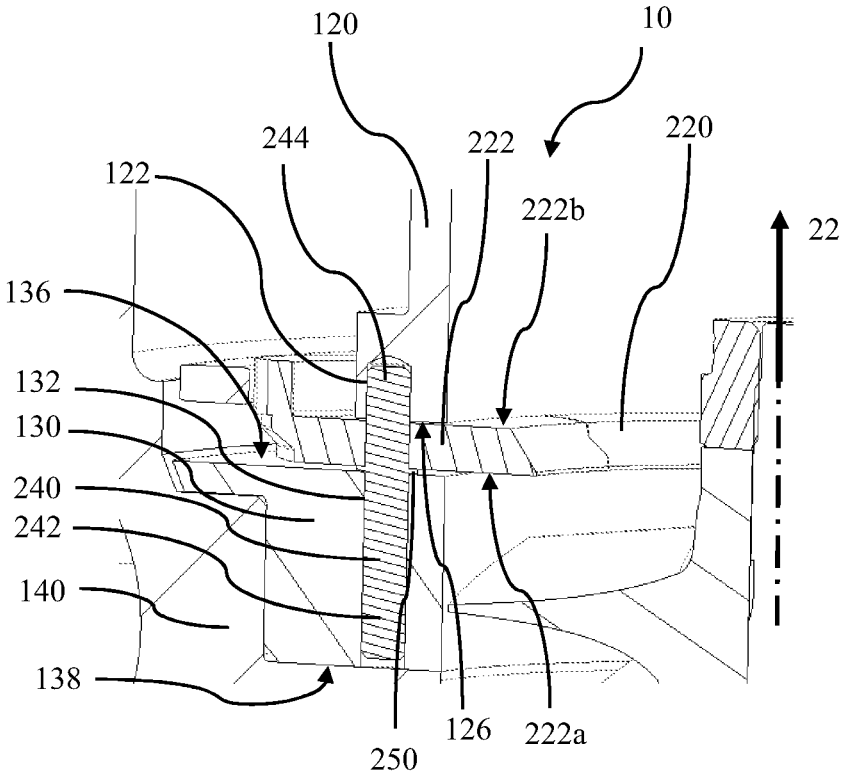
Figure 7A:
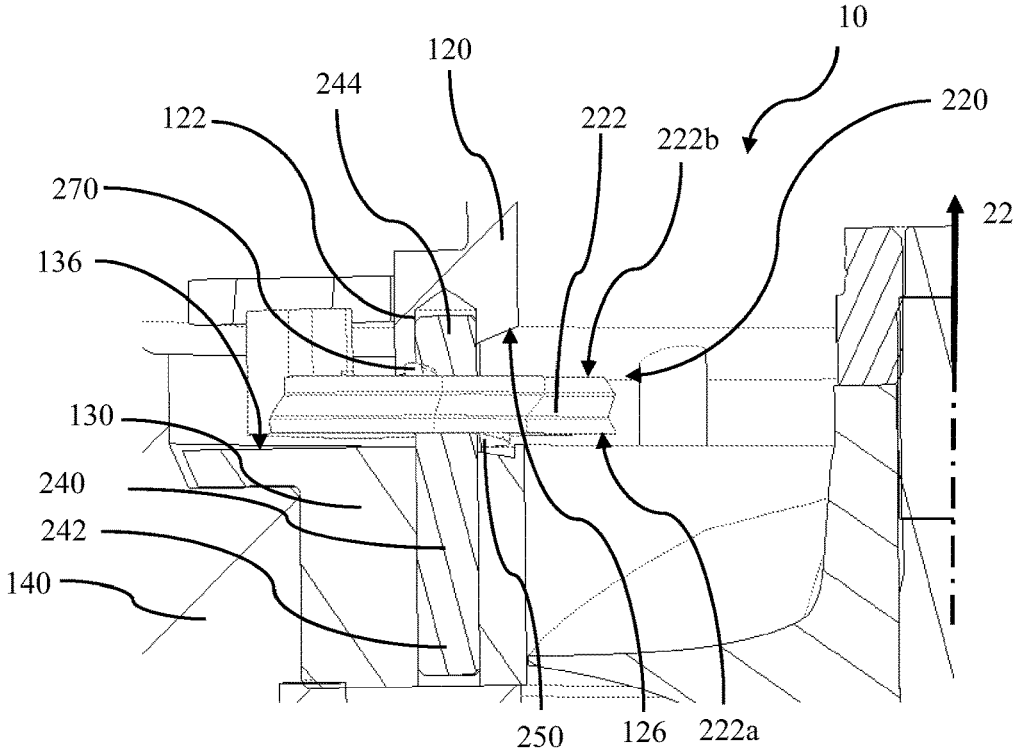
FIGS. 7A-7B show the inventive arrangement with a third exemplary embodiment of distance elements and with cams.
Figure 7B:
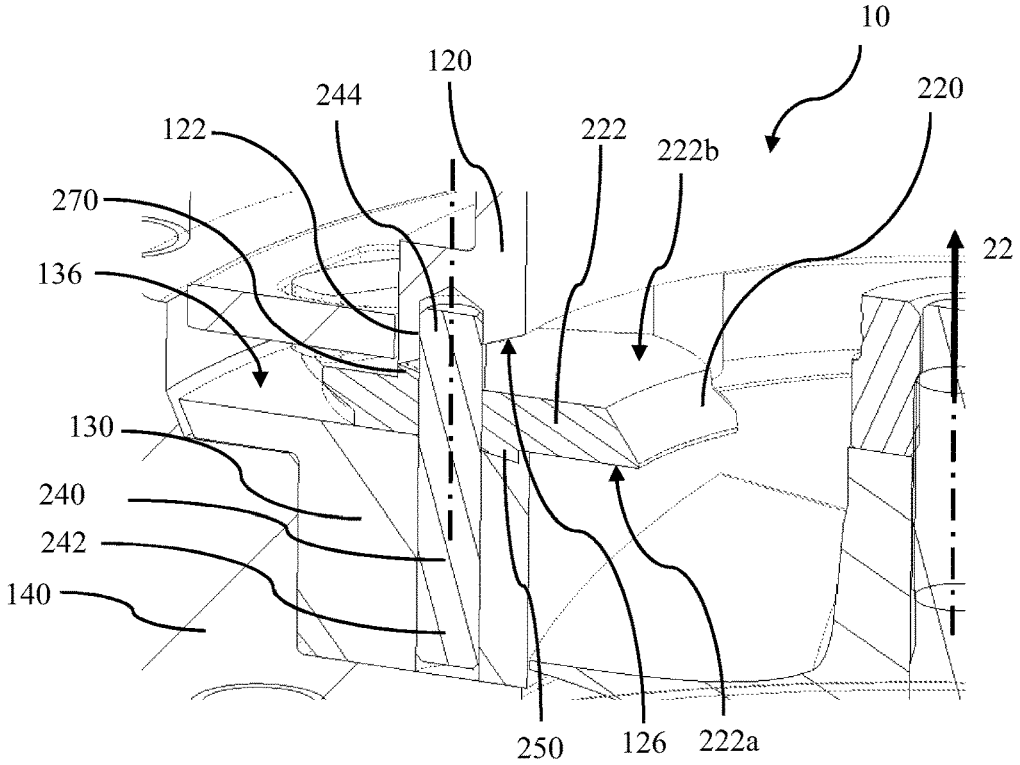

As shown, for instance in the FIGS. 3A-3C, each respective shaft 240 is integrally formed with the respective orifice element 220. This may result in easier manufacturing and less production cost and may increase the stability of the part. In other embodiments, for instance FIGS. 4A-8C, the shafts 240 may be separately formed from the orifice elements 220. In such embodiments, each orifice element 220 comprises a central bore 224 which extends axially through the base plate 222 of each respective orifice element 220 (see e.g. FIG. 4A). Each central bore 224 is thereby configured to receive a respective shaft 240. For instance, size and shape of the shafts 240 and/or size and shape of the respective bores 224 may be adapted to be engageable with each other. For instance, shafts 240 and/or bores 224 may be adapted such that shafts 240 are press-fittingly received in the respective bores 224. In embodiments wherein shafts 240 and orifice elements 220 are separate parts, they also may be made of different materials. For instance, a shaft 240 may be made of a metallic material, whereas the orifice elements 220 may be made of a polymeric material. Thereby, the shafts 240 may be accordingly configured in their respective first and/or second end portions 242, 244 to reduce friction, as described further above (e.g. coating).

Another option to reduce friction, which is combinable with both embodiments—those with a one-sided shaft 240 or those with a double-sided shaft 240—is correspondingly configuring the ring-shaped insert member 130. The ring-shaped insert member 130 is made of a wear reducing material or can comprise a wear reducing surface coating. In particular, the wear reducing material or the wear reducing surface coating comprises a polymer material or polymeric coating, respectively.

In alternative embodiments (not depicted), the ring-shaped insert member 130 may be integrally formed with the main body 140. Thus, the functionality of the ring-shape insert member 130 may be integrated into the main body 140 of the compressor housing 100. For instance, this could be achieved by providing (in an analogous fashion to providing the bores 132) a plurality of bores in the main body 140 directly. Further, a wear reducing coating could be provided in the area of the bores. Alternatively, wear reducing inserts for each bore, such as polymeric hollow cylinders for receiving the shafts could be insertingly provided in the bores. The latter features may also be possible for the ring-shaped insert member 130.

Figure 8A:
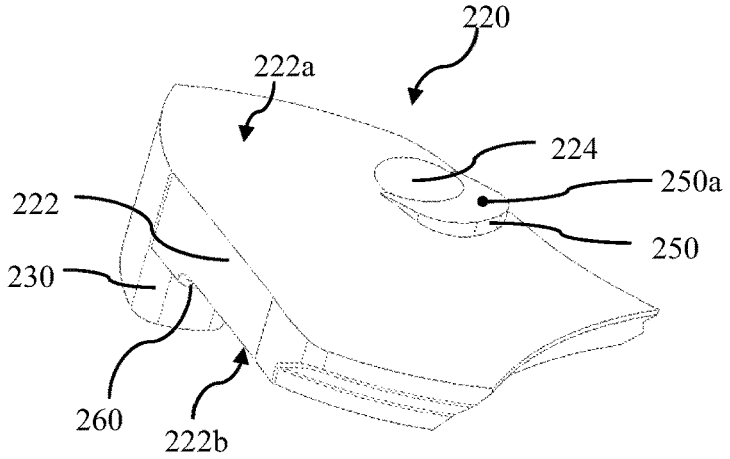
FIGS. 8A-8C show detailed views of distance elements and cams together with orifice elements according to the arrangement of FIGS. 7A-7B.
Figure 8B:
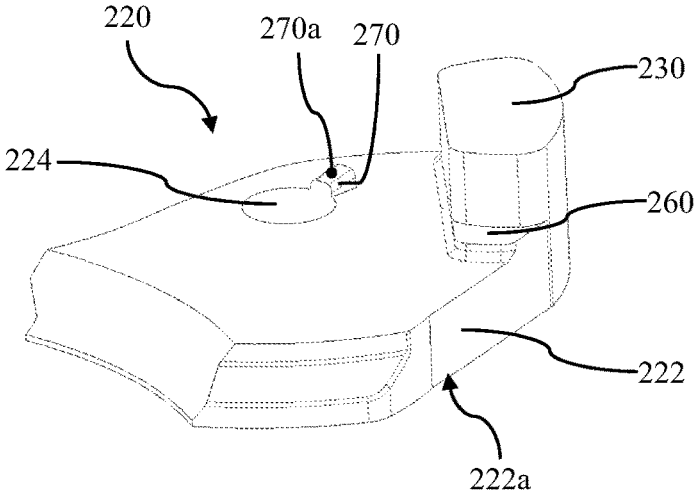

The adjustment mechanism 200 further comprises a plurality of plateau elements 260 (see, e.g., FIG. 2A, 3A or 8B). Each of the plurality of plateau elements 260 is arranged axially between a respective orifice element 220 and the actuation ring 210 (see e.g. FIG. 9C). More specifically, each of the plurality of plateau elements 260 is arranged axially between the base plate 222 of a respective orifice element 220 and the actuation ring 210. In the exemplary embodiments disclosed herein, each of the plurality of plateau elements 260 is arranged directly adjacent to a respective coupling element 230. Furthermore, there is provided one plateau element 260 per orifice element 220. In alternative embodiments, each of the plurality of plateau elements 260 could be arranged further away from the respective coupling element 230. Also, alternatively, there could be more or less than one plateau element 260 provided per orifice element 220. In the present embodiments each of the plurality of plateau elements 260 is integrally formed with a respective orifice element 220. Alternatively, each of the plurality of plateau elements 260 could be integrally formed with a respective coupling element 230. Alternatively, each of the plurality of plateau elements 260 may be integrally formed with the actuation ring 210. Alternatively, each of the plurality of plateau elements 260 may be a separate part and may form-fittingly or otherwise be attached to the orifice element 220, the actuation ring 210 or the coupling element 230. By providing plateau elements 260 axially between the actuation ring 210 and the respective orifice elements 220, the contact area, and thus the sliding area between the orifice elements 220 and the actuation ring 210 can be reduced. Furthermore, by providing the plateau elements 260 adjacent to the respective coupling elements 230, thus close to the relative pivot point between a respective orifice element 220 and the actuation ring 210, the lever of relative movement of the contact between actuation ring 210 and respective orifice element 220 can be reduced. Thus, the arc length of movement, and thereby the contact area during rotation is also reduced. This results in less friction in that area, leading to less wear of the adjustment mechanism 200.

In the present embodiments, each coupling element 230 is integrally formed with a respective orifice element 220 (see e.g. FIG. IA). In alternative embodiments, each coupling element 230 may be a separate part from a respective orifice element 220 and thus, may be connected with a respective orifice element 220 otherwise than by substance bonding.

Figure 8C:
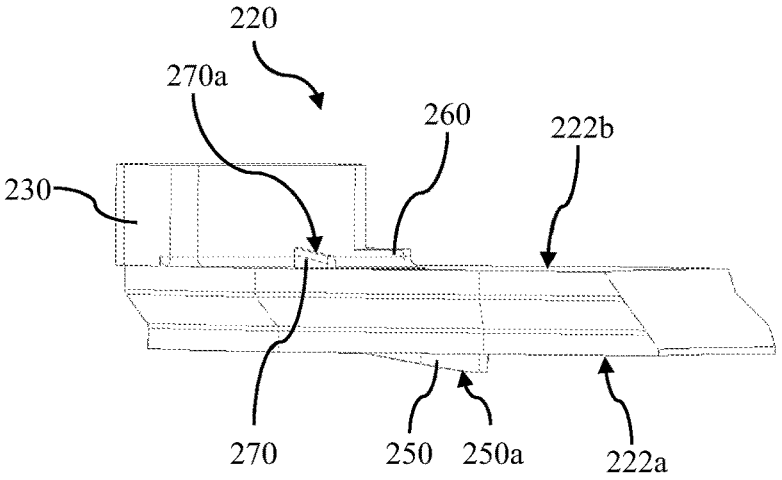

In some advantageous embodiments, the at least one wear reducing feature comprises a plurality of distance elements 250 (see, e.g., FIGS. 5A-6C). Each of the plurality of distance elements 250 is arranged axially between a respective orifice element 220 and the main body 140. More specifically, each of the plurality of distance elements 250 is arranged axially between the base plate 222 of a respective orifice element 220 and the ring-shaped insert member 130. In alternative embodiments without ring-shaped insert member 130 or wherein the ring-shaped insert member 130 is integrally formed with the main body 140, each of the plurality of distance elements 250 may be arranged axially between the base plate 222 of a respective orifice element 220 and the main body 140. In some embodiments, each distance element 250 is integrally formed with a respective orifice element 220 (see, e.g., FIGS. 5A-5B). Thus, in other words, each distance element 250 may axially protrude from the first end face 222*a* of a respective orifice element 220. In some other embodiments, each distance element 250 may be integrally formed with a respective shaft 240 (see, e.g., FIGS. 6A-6C). In further alternative embodiments (not depicted in the figures), the distance elements 250 may be integrally formed with the main body 140 or the ring-shaped insert member 130, or they may be provided as separate parts. Although, only described in embodiments in correspondence with a double-sided shaft 240, also embodiments with one-sided shafts 240 may comprise a plurality of distance elements 250. Each distance element 250 is configured to axially support a respective orifice element 220 against the compressor housing 100. That means, each orifice element 220 contacts the housing 100, i.e. the main body 140 (not depicted) or, if applicable the ring-shaped insert member 130, via the respective distance element 250. Each of the plurality of distance elements 250 is arranged adjacent a respective shaft 240 (see, e.g., FIGS. 5B, 6C). Thereby, when rotating an orifice element 220, the lever of movement is short in comparison to a distance element 250 which is arranged further away from a respective shaft 240. Thus, the arc length of movement, and thereby the contact area during rotation is also reduced. This results in less friction in that area, leading to less wear of the arrangement 10. In general, by providing a distance element 250 on each orifice element 220, i.e. between an orifice element 220 and the main body 140 or the ring-shaped insert member 130, the contact area, and thus the sliding area between the orifice elements 220 and the main body 140 or, if applicable, the ring-shaped insert member 130, can be reduced. This results in less friction in that area, leading to less wear of the arrangement 10. With regard to FIGS. 5A and 6B, it is shown, that each distance element 250 comprises a ring-like shape and circumferentially surrounds the respective shaft 240 or the respective bore 224, respectively. In other embodiments, each distance element 250 may comprise another shape than a ring-like shape. For instance, FIGS. 8A-8C depict an exemplary embodiment with a distance element 250 having a substantially wedge-like or spline-like shape (will be described further below in detail). As depicted in the figures, the number of distance elements 250 equals the number of orifice elements 220. Thereby, each distance element 250 is assigned to one orifice element 220, respectively. In alternative embodiments the number of distance elements 250 can be higher or lower than the number of orifice elements 220. Also, the distribution and/or the arrangement of distance elements 250 to the orifice elements 220 and/or the arrangement of the distance elements 250 on the orifice elements 220 may be different.

With regard to FIGS. 7A-9C, the at least one wear reducing feature further comprises a plurality of cams 270. Each of the cams 270 is arranged axially between a respective orifice element 220 and the inlet cover 120. More specifically, each of the plurality of cams 270 is arranged axially between the base plate 222 of a respective orifice element 220 and the inlet cover 120. Thus, the number of cams 270 equals the number of orifice elements 220. Thereby, each cam 270 is assigned to one orifice element 220, respectively. In alternative embodiments the number of cams 270 can be higher or lower than the number of orifice elements 220. Also, the distribution of cams 270 to the orifice elements 220 and/or the arrangement of the cams 270 on the orifice elements 220 may be different.

The plurality of distance elements 250 is configured to interact with a correspondingly configured first annular end face 136 of the ring-shaped insert member 130. Furthermore, the plurality of cams 270 is configured to interact with a correspondingly configured first annular end face 126 of the inlet cover 120 such that, in a closed position of the adjustment mechanism 200, in which the cross-section of the compressor inlet 110 is minimal, the inlet cover 120 enacts an axial pre-load on the orifice elements 220, to press fit the orifice elements 220 axially between the inlet cover 120 and the ring-shaped insert member 130 (see, e.g., FIGS. 7A-9C). By axially preloading the orifice elements 220 towards the ring-shaped insert member 130, an axial gap between the orifice elements 220 and the ring-shaped insert member 130 can be reduced or closed. This leads to a sealing effect in that gap area, preventing backflow of fluids from the impeller of the compressor which results in a higher efficiency of the system.

Figure 9A:
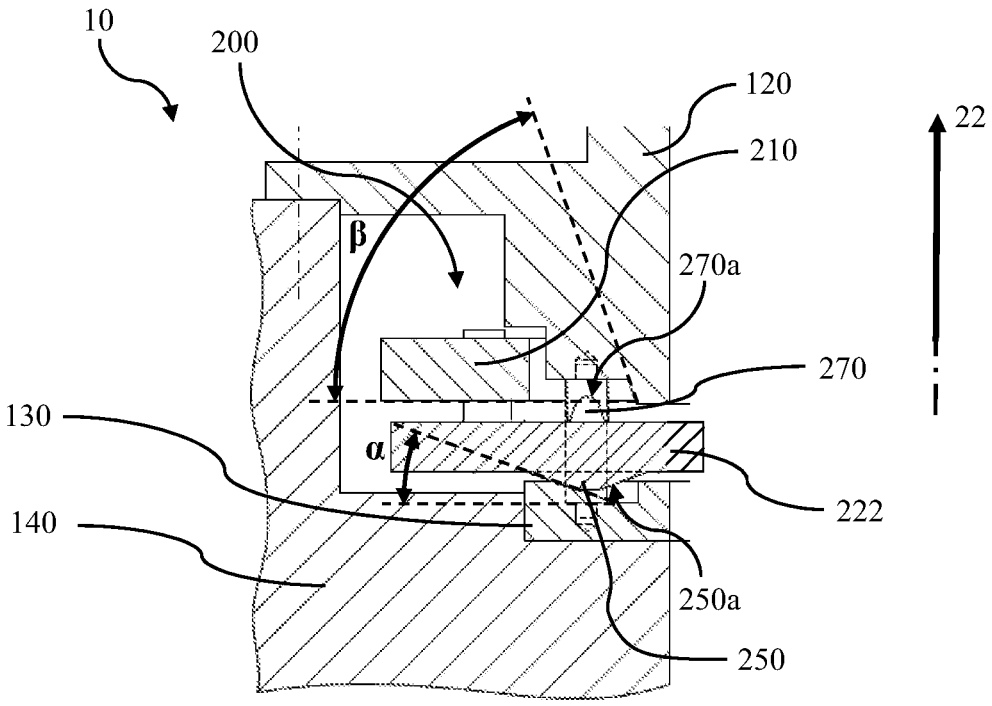
FIGS. 9A-9C show detailed sectional views of the arrangement with distance elements and cams similar to the FIGS. 7A-7B, but with different embodiments of the insert member and the inlet cover.
Figure 9B:
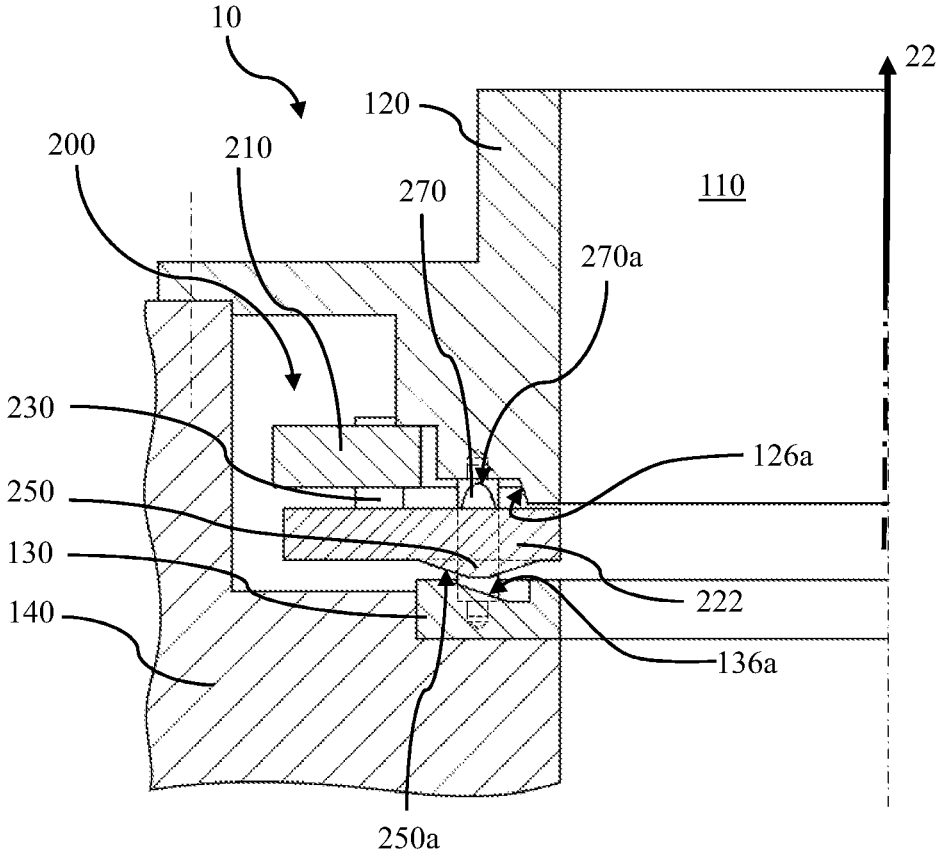
Figure 9C:
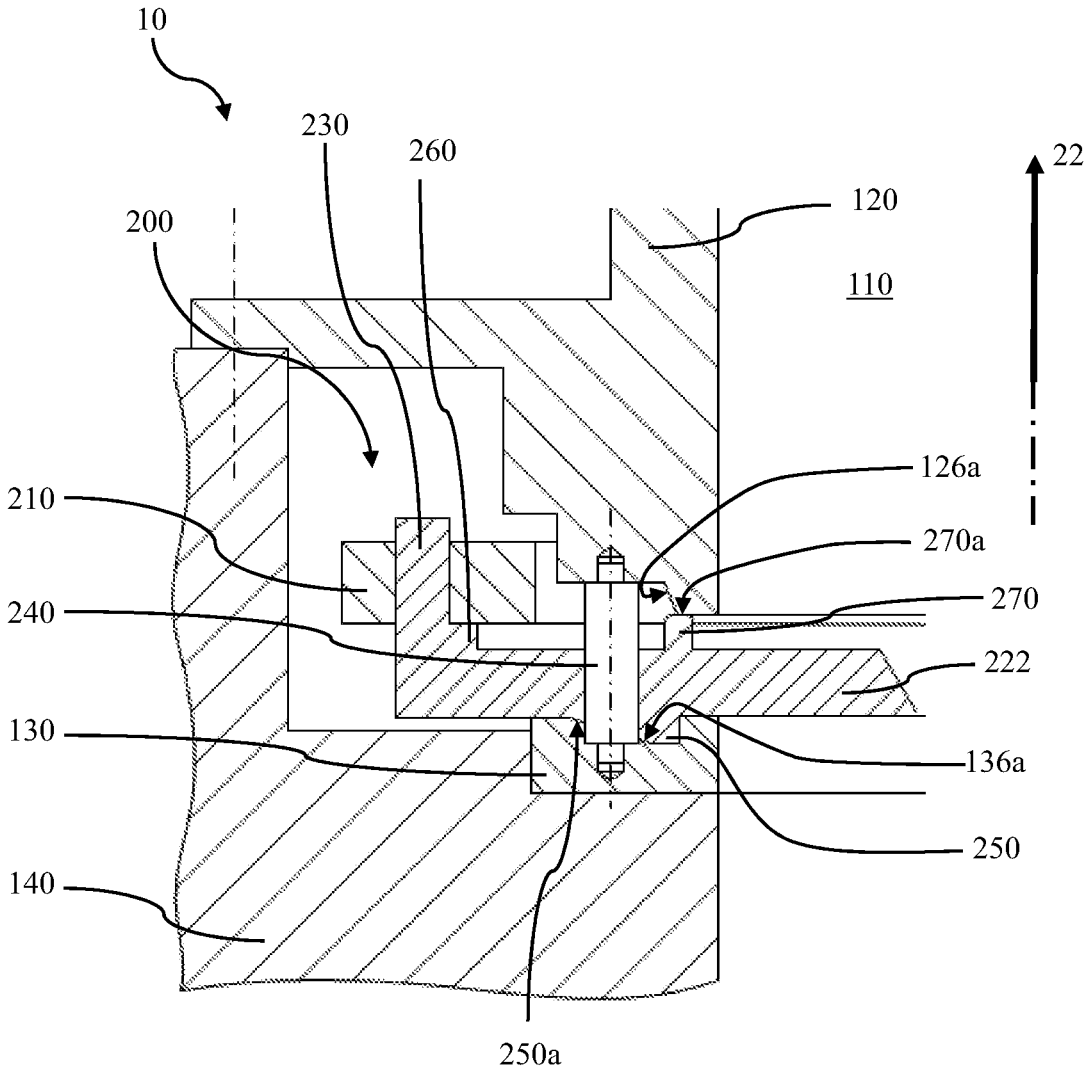

In this regard, FIGS. 7A-8C show one embodiment and FIGS. 9A-9C show another embodiment of the latter aspect. In more detail, this aspect and further aspects related therewith will be explained in the following only with regard to FIGS. 9A-9C for illustrative purposes. Nevertheless, this should not be understood as a restriction to the embodiments depicted in said FIGS. 9A-9C. For illustrative purposes, some aspects will be described with regard to a simple entity, for instance, with respect to one orifice element 220. Nevertheless, the following features are to be understood applicable to all respective parts of one kind.

FIGS. 9A-9C show sectional views of the arrangement 10 with the adjustment mechanism 200 in three different positions. FIG. 9B shows a first position of the adjustment mechanism 200 in a fully opened state resulting in a maximum cross-section of the compressor inlet 110. FIG. 9C shows a second position of the adjustment mechanism 200 in a fully closed state resulting in a reduced cross-section of the compressor inlet 110, thus representing the minimum cross-section of the compressor inlet 110. FIG. 9A shows a third position of the adjustment mechanism 200 representing an exemplary intermediate position of the adjustment mechanism 200 between the fully opened and the fully closed state, resulting in a reduced cross-section of the compressor inlet 110 in comparison to the maximum cross-section of the compressor inlet 110, but a larger cross-section than the minimum cross-section.

As can be taken from the FIGS. 9A-9C each of the plurality of distance elements 250 has an inclined surface 250*a* (also compare to the inclined surface 250*a*, e.g. in FIG. 8A). The inclined surface 250*a* is configured to slidingly engage a respective portion 136*a* of the first annular end face 136 of the ring-shaped insert member 130, which is correspondingly inclined. That means, starting from the fully closed position of the adjustment mechanism 200 wherein the inclined surface 250*a* matingly engages with a corresponding portion 136*a* of the first annular end face 136 (see, e.g., FIG. 9C), the distance element 250 slides up the inclined portion 136*a* of the first annular end face 136 upon rotation of the orifice element 220 towards the fully opened position. Thereby, the orifice element 220 is moved axially away from the first annular end face 136, resulting in that the orifice element 220 substantially slides on the ring-shaped insert member 130 via its distance element 250. In alternative embodiments without ring-shaped insert member 130 or wherein the ring-shaped insert member 130 is integrally formed with the main body 140, the orifice element 220 substantially slides on the main body 140 via its distance element 250, analogously. This leads to a reduced contact area and thus to less friction and wear. At the same time a high sealing capability between an orifice element 220 and the ring-shaped insert member 130, or if applicable the main body 140, is maintained in the fully closed position. The person skilled in the art will understand, that an adaption of the distance element 250, i.e. the inclined surface 250*a* in correspondence with an adaption of the first annular end face 136, i.e. the inclined portion 136*a* will influence the amount and fashion of axial movement of the orifice element 220. Furthermore, this will influence the transition behavior between full contact (see FIG. 9C) of orifice element 220 and ring-shaped insert member 130 and minimal contact (see, e.g., FIG. 9A or 9B) via the distance element 250, or if applicable a portion of the distance element 250, during rotation of the orifice element 220. Although exemplary described for only a single orifice element 220, the latter is applicable to all orifice elements 220. Analogously, connected elements, such as the inclined portion 136*a* of the first annular end face 136, are provided correspondingly for the functionality of the other orifice elements 220 during rotation.

Furthermore, each of the plurality of cams 270 has an inclined surface 270*a*. The inclined surface 270*a* is configured to slidingly engage a respective portion 126*a* of the first annular end face 126 of the inlet cover 120, which is correspondingly inclined. Analogously to the above explained, a rotation of an orifice element 220 causes an axial translation of that respective orifice element 220 due to the interaction between inclined surface 270*a* of the cam 270 and the inclined portion 126*a* of the first annular end face 126, but in an axial direction 22 opposite to that caused by the interaction of a distance element 250 sliding on the inclined portion 136*a* of the first annular end face 136. More specifically, starting from an intermediate position of the adjustment mechanism 200 (see, e.g., FIG. 9A) the distance element 250 first only slides down the inclined portion 136*a* during rotation of the orifice element 220 towards the fully closed position. But at a specific degree of rotation, when the cam 270 engages the inclined portion 126*a* of the inlet cover 120, the orifice element 220 is "pressed down". In other words, the orifice element 220 is moved in an axial direction 22 towards the first annular end face 136 of the ring-shaped insert member 130, as the cam 270 slides up the inclined portion 126*a* of the first annular end face 126. The inclined portions 126*a* and 136*a* can be further defined by angles $\alpha$ and $\beta$. Thereby, $\alpha$ defines an inclination angle of the inclined portion 136*a* and $\beta$ defines an inclination angle of the inclined portion 126*a*. Preferred ranges for the angles $\alpha$ and $\beta$ and a relationship between the angles $\alpha$ and $\beta$ can be described as follows:

$$0° > \alpha < 45° \text{ and } \alpha < \beta \leq 90°.$$

Especially, the feature "$\beta$ being larger than $\alpha$" results in the effect that during rotation of an orifice element 220 to the fully closed position, the axial force enacted on the cam 270 by the inclined portion 126*a* progressively increases, leading to an axial "locking effect" of the orifice element 220 against the ring-shaped insert member 130. Thereby, the geometric dimensions and arrangements of the distance element 250, i.e. the inclined surface 250*a*, the first annular end face 136, i.e. the inclined portion 136*a*, the cam 270, i.e. the inclined surface 270*a* and/or the first annular end face 126, i.e. the inclined portion 126*a* are adequately adjusted such that the orifice element 220 first contacts the first annular end face 136 to close the gap between orifice element 220 and ring-shaped insert member 130 before said "locking effect" sets in. This advantageous feature ensures that during rotation from an opened position to a closed position of the adjustment mechanism 200, the orifice elements 220 experience an increasing axial preload. In general, the inclined portions 126*a* and 136*a* may be configured as annular grooves, thus extending circumferentially on the first annular end faces 126 and 136, respectively. Alternatively, the inclined portions 126*a* and 136*a* may be configured as a plurality of recesses or protrusion, thus being distributed circumferentially at distinct positions close to the respective rotation axis of an orifice element 220.

When moving to the fully opened position, the distance element 250 is adjusted such that the actuation ring 210, which is axially moved together with the orifice element 220 during rotation, at least in the fully opened position contacts the inlet cover 120. Thereby, an axial support for the adjustment mechanism 200 is ensured at least in the fully closed position. In alternative embodiments, the plateau element 260 could also comprise an inclined surface (not depicted), in a similar fashion to the inclined surface of portion 136*a*, to enact an axial preload on the actuation ring 210 against the inlet cover 120 during rotation towards the fully opened position.

In alternative embodiments, the at least one wear reducing feature may comprise one or more wear reducing surface coatings, which are arranged on at least one of the inlet cover 120, the actuation ring 210, the orifice elements 220. Thereby, the wear reducing surface coating comprises a polymeric coating. This leads to a further reduction of wear in the arrangement 10.

The present invention further relates to a charging device (not depicted). The charging device comprises an arrangement 10 of any one of the previous aspects. In another aspect, which is combinable with the previous aspect, the charging device may be an exhaust gas turbocharger and further comprises a turbine. Additionally or alternatively, the charging device may be an electrically assisted turbocharger and may further comprise an electrical assist device. Alternatively, the charging device may be an electric charger and may further comprise an electric motor which drives the impeller mounted in the compressor housing 100.

It should be understood that the present invention can also alternatively be defined in accordance with the following embodiments:

1. An arrangement (10) for variably adjusting the cross-section of a compressor inlet (110) comprising:

a compressor housing (100) with a main body (140) and an inlet cover (120) defining a compressor inlet (110);

an adjustment mechanism (200) arranged in the compressor housing (100), wherein the adjustment mechanism (200) comprises an actuation ring (210) and a plurality of orifice elements (220), wherein each orifice element (220) is coupled to the actuation ring (210) via a respective coupling element (230) and wherein each orifice element (220) is rotatably supported in the compressor housing (100) via a respective shaft (240);

characterized in that the arrangement (10) comprises at least one wear reducing feature providing a wear reduced operation of the adjustment mechanism (200).

2. The arrangement (10) of embodiment 1, wherein the at least one wear reducing feature comprises a ring-shaped insert member (130) of the compressor housing (100), wherein the ring-shaped insert member (130) is arranged axially between the orifice elements (220) and the main body (140) and wherein the ring-shaped insert member (130) is configured to axially support the adjustment mechanism (200) axially opposite of the inlet cover (120).

3. The arrangement (10) of embodiment 2, wherein the ring-shaped insert member (130) is attached to the main body (140) by means of a press-fit (144) between an inner circumferential surface (142) of the main body (140) and an outer circumferential surface (134) of the ring-shaped insert member (130).

4. The arrangement (10) of any one of the embodiments 2 or 3, wherein the ring-shaped insert member (130) is attached to the main body (140) by means of two or more press-fit pins (145) each of which is arranged in a press-fitting manner in a respective attachment bore (147) of the main body (140) and a respective attachment bore (137) of the ring-shaped insert member (130).

5. The arrangement (10) of any one of the embodiments 2 to 4, wherein the ring-shaped insert member (130) is attached to the main body (140) by means of two or more screws (146).

6. The arrangement (10) of any one of the embodiments 2 to 5, wherein the ring-shaped insert member (130) comprises a plurality of bores (132), each of the plurality of bores (132) being configured to rotatably receive a respective shaft (240), wherein the plurality of bores (132) are circumferentially distributed on a first annular end face (136) of the ring-shaped insert member (130), the first annular end face (136) facing axially towards the adjustment mechanism (200).

7. The arrangement (10) of embodiment 6, wherein each of the shafts (240) has an axial length (240*a*) which is longer than an axial length (132*a*) of each respective bore (132).

8. The arrangement (10) of any one of embodiments 6 or 7, wherein each of the plurality of bores (132) is a through hole or wherein each of the plurality of bores (132) is a blind hole.

9. The arrangement (10) of any one of embodiments 6 to 8, wherein each of the shafts (240) has a first end portion (242) which is made of a wear reducing material or which comprises a wear reducing surface coating, in particular, wherein the wear reducing material or the wear reducing surface coating comprises a polymer material or polymeric coating, respectively.

10. The arrangement (10) of any one of embodiments 2 to 9, wherein each of the shafts (240) extends from a first end face (222*a*) of a base plate (222) of an orifice element (220) axially towards the ring-shaped insert member (130).

11. The arrangement (10) of embodiment 10, wherein each of the shafts (240) further extends from the first end face (222*a*) axially through the base plate (222) and further extends from a second end face (222*b*) of the base plate (222), which is axially opposite of the first end face (222*a*), axially towards the inlet cover (120).

12. The arrangement (10) of any one of the previous embodiments, wherein the inlet cover (120) comprises a plurality of bores (122), each of the plurality of bores (122) being configured to rotatably receive a respective shaft (240) and, the plurality of bores (122) being circumferentially distributed on a first annular end face (126) of the inlet cover (120), the first annular end face (126) axially facing towards the adjustment mechanism (200).

13. The arrangement (10) of embodiment 12, if dependent on embodiment 9, wherein each of the shafts (240) has a second end portion (244) axially opposite of the first end portion (242) which is made of a wear reducing material or which comprises a wear reducing surface coating, in particular, wherein the wear reducing material or the wear reducing surface coating comprises a polymer material or polymeric coating, respectively.

14. The arrangement (10) of any one of embodiments 1 to 13, wherein each respective shaft (240) is integrally formed with a respective orifice element (220).

15. The arrangement (10) of any one of embodiments 1 to 13, wherein each orifice element (220) comprises a central bore (224) extending axially through the base plate (222) of each respective orifice element (220) and wherein each central bore (224) is configured to receive a respective shaft (240).

16. The arrangement (10) of any one of embodiments 2 to 15, wherein the ring-shaped insert member (130) is made of a wear reducing material or comprises a wear reducing surface coating, in particular, wherein the wear reducing material or the wear reducing surface coating comprises a polymer material or polymeric coating, respectively.

17. The arrangement (10) of any one of embodiments 2 to 16, wherein the ring-shaped insert member (130) is integrally formed with the compressor housing (100).

18. The arrangement (10) of any one of the previous embodiments, wherein the adjustment mechanism (200) further comprises a plurality of plateau elements (260), wherein each of the plurality of plateau elements (260) is arranged axially between a respective orifice element (220) and the actuation ring (210).

19. The arrangement (10) of embodiment 18, wherein each of the plurality of plateau elements (260) is arranged directly adjacent to a respective coupling element (230).

20. The arrangement (10) of any one of embodiments 18 or 19, wherein each of the plurality of plateau elements (260) is integrally formed with a respective coupling element (230) and/or with a respective orifice element (220) or alternatively, wherein each of the plurality of plateau elements (260) is integrally formed with the actuation ring (210).

21. The arrangement (10) of any one of the previous embodiments, wherein the at least one wear reducing feature comprises a plurality of distance elements (250), wherein each of the plurality of distance elements (250) is arranged axially between a respective orifice element (220) and the main body (140).

22. The arrangement (10) of embodiment 21, wherein each distance element (250) is integrally formed with a respective orifice element (220).

23. The arrangement (10) of any one of embodiments 21 or 22, wherein each distance element (250) is configured to axially support a respective orifice element (220) against the compressor housing (100).

24. The arrangement (10) of any one of embodiments 21 to 23, wherein each of the plurality of distance elements (250) is arranged adjacent a respective shaft (240).

25. The arrangement (10) of any one of embodiments 21 to 24, wherein each distance element (250) comprises a ring-like shape and circumferentially surrounds each respective shaft (240).

26. The arrangement (10) of any one of embodiments 21 or 23 to 25, wherein each distance ring (250) is integrally formed with a respective shaft (240).

27. The arrangement (10) of any one of embodiments 21 to 24, wherein the at least one wear reducing feature further comprises a plurality of cams (270), wherein each of the cams (270) is arranged axially between a respective orifice element (220) and the inlet cover (120).

28. The arrangement (10) of embodiment 27, wherein the plurality of distance elements (250) is configured to interact with a correspondingly configured first annular end face (136) of the ring-shaped insert member (130) and, wherein the plurality of cams (270) are configured to interact with a correspondingly configured first annular end face (126) of the inlet cover (120) such that in a closed position of adjustment mechanism (200) in which the cross-section of the compressor inlet (110) is minimal, the inlet cover (120) enacts an axial pre-load on the orifice elements (220), to press fit the orifice elements (220) axially between the inlet cover (120) and the ring-shaped insert member (130).

29. The arrangement (10) of any one of embodiments 27 or 28, wherein each of the plurality of distance elements (250) has an inclined surface (250*a*) which is configured to slidingly engage a respective portion (136*a*) of the first annular end face (136), which is correspondingly inclined and wherein each of the plurality of cams (270) has an inclined surface (270*a*) which is configured to slidingly engage a respective portion (126*a*) of the first annular end face (126), which is correspondingly inclined, such that a rotation of an orifice element (220) causes an axial translation of that respective orifice element (220).

30. The arrangement (10) of embodiment 29, wherein an inclination angle β of the respective portion (126*a*) of the first annular end face (126) is larger than an inclination angle α of the respective portion (136*a*) of the first annular end face (136).

31. The arrangement (10) of any one of the previous embodiments, wherein the at least one wear reducing feature comprises one or more wear reducing surface coating, wherein the one or more wear reducing surface coating is arranged on at least one of the inlet cover (120), the actuation ring (210), the orifice elements (220) and wherein the wear reducing surface coating comprises a polymeric coating.

32. A charging device comprising an arrangement (10) of any one of the previous embodiments.

33. The charging device of embodiment 32, wherein the charging device is an exhaust gas turbocharger and further comprises a turbine.

34. The charging device of any one of embodiments 32 or 33, wherein the charging device is an electrically assisted turbocharger and further comprises an electrical assist device.

35. The charging device of embodiment 32, wherein the charging device is an electric charger and further comprises an electric motor which drives the impeller mounted in the compressor housing (100).

The invention claimed is:

1. An arrangement (10) for variably adjusting the cross-section of a compressor inlet (110) comprising:

a compressor housing (100) with a main body (140) and an inlet cover (120) defining the compressor inlet (110);

an adjustment mechanism (200) arranged in the compressor housing (100), wherein the adjustment mechanism (200) comprises an actuation ring (210) and a plurality of orifice elements (220), wherein each orifice element (220) is coupled to the actuation ring (210) via a respective coupling element (230) and wherein each orifice element (220) is rotatably supported in the compressor housing (100) via a respective shaft (240);

characterized in that the arrangement (10) comprises at least one wear reducing feature providing a wear reduced operation of the adjustment mechanism (200), wherein the at least one wear reducing feature comprises a plurality of distance elements (250), wherein each of the plurality of distance elements (250) is arranged axially between a respective orifice element (220) and the main body (140), wherein the at least one wear reducing feature further comprises a plurality of cams (270), wherein each of the cams (270) is arranged axially between a respective orifice element (220) and the inlet cover (120), and wherein each of the plurality of distance elements (250) has an inclined surface (250*a*) which is configured to slidingly engage a respective portion (136*a*) of the first annular end face (136) of a ring-shaped insert member (130), which is correspondingly inclined and wherein each of the plurality of cams (270) has an inclined surface (270*a*) which is configured to slidingly engage a respective portion (126*a*) of the first annular end face (126) of the inlet cover (120), which is correspondingly inclined, such that a rotation of an orifice element (220) causes an axial translation of that respective orifice element (220).

2. The arrangement (10) of claim 1, wherein the at least one wear reducing feature comprises the ring-shaped insert member (130) of the compressor housing (100), wherein the ring-shaped insert member (130) is arranged axially between the orifice elements (220) and the main body (140) and wherein the ring-shaped insert member (130) is configured to axially support the adjustment mechanism (200) axially opposite of the inlet cover (120).

3. The arrangement (10) of claim 2, wherein the ring-shaped insert member (130) comprises a plurality of bores (132), each of the plurality of bores (132) being configured to rotatably receive the respective shaft (240), wherein the plurality of bores (132) are circumferentially distributed on a first annular end face (136) of the ring-shaped insert member (130), the first annular end face (136) facing axially towards the adjustment mechanism (200).

4. The arrangement (10) of claim 2, wherein each of the shafts (240) extends from a first end face (222*a*) of a base plate (222) of each orifice element (220) axially towards the ring-shaped insert member (130).

5. The arrangement (10) of claim 4, wherein each of the shafts (240) further extends from the first end face (222*a*) axially through the base plate (222) and further extends from a second end face (222*b*) of the base plate (222), which is axially opposite of the first end face (222*a*), axially towards the inlet cover (120).

6. The arrangement (10) of claim 2, wherein the ring-shaped insert member (130) is made of a wear reducing material or comprises a wear reducing surface coating.

7. The arrangement (10) of claim 6, wherein the wear reducing material or the wear reducing surface coating comprises a polymer material or polymeric coating, respectively.

8. The arrangement (10) of claim 1, wherein the inlet cover (120) comprises a plurality of bores (122), each of the plurality of bores (122) being configured to rotatably receive the respective shaft (240) and, the plurality of bores (122) being circumferentially distributed on a first annular end face (126) of the inlet cover (120), the first annular end face (126) axially facing towards the adjustment mechanism (200).

9. The arrangement (10) of claim 1, wherein the adjustment mechanism (200) further comprises a plurality of plateau elements (260), wherein each of the plurality of plateau elements (260) is arranged axially between a respective orifice element (220) and the actuation ring (210).

10. The arrangement (10) of claim 1, wherein each distance element (250) is configured to axially support a respective orifice element (220) against the compressor housing (100).

11. The arrangement (10) of claim 1, wherein the plurality of distance elements (250) is configured to interact with a correspondingly configured first annular end face (136) of the ring-shaped insert member (130) and, wherein the plurality of cams (270) are configured to interact with a correspondingly configured first annular end face (126) of the inlet cover (120) such that in a closed position of adjustment mechanism (200) in which the cross-section of the compressor inlet (110) is minimal, the inlet cover (120) enacts an axial pre-load on the orifice elements (220), to press fit the orifice elements (220) axially between the inlet cover (120) and the ring-shaped insert member (130).

12. The arrangement (10) of claim 1, wherein an inclination angle β of the respective portion (126*a*) of the first annular end face (126) is larger than an inclination angle α of the respective portion (136*a*) of the first annular end face (136).

13. A charging device comprising an arrangement (10) of claim 1.

* * * * *